US012311243B2

(12) United States Patent
Sudeith et al.

(10) Patent No.: US 12,311,243 B2
(45) Date of Patent: May 27, 2025

(54) EXPANDABLE CLIMBING PANEL AND CLIMBING WALL HAVING SUCH A PANEL

(71) Applicant: Everlast Climbing Industries, Inc., Crystal, MN (US)

(72) Inventors: Timothy S. Sudeith, Edina, MN (US); Sarah M. Howard, Lakeville, MN (US); Joseph Sweeney, Minneapolis, MN (US); Nicolas Oklobzija, White Bear Lake, MN (US)

(73) Assignee: EVERLAST CLIMBING INDUSTRIES, INC., Crystal, MN (US)

( * ) Notice: Subject to any disclaimer, the term of this patent is extended or adjusted under 35 U.S.C. 154(b) by 0 days.

(21) Appl. No.: 17/891,653

(22) Filed: Aug. 19, 2022

(65) Prior Publication Data

US 2022/0387869 A1 Dec. 8, 2022

Related U.S. Application Data

(63) Continuation of application No. 17/167,813, filed on Feb. 4, 2021, now Pat. No. 11,452,924.
(Continued)

(51) Int. Cl.
*A63B 69/00* (2006.01)

(52) U.S. Cl.
CPC ..... *A63B 69/0048* (2013.01); *A63B 2225/09* (2013.01)

(58) Field of Classification Search
CPC ..... A63B 69/0048; A63B 2225/09
See application file for complete search history.

(56) References Cited

U.S. PATENT DOCUMENTS 3,741,538 A 6/1973 Lewis et al.
5,549,195 A 8/1996 Aulagner et al.
(Continued)

FOREIGN PATENT DOCUMENTS

BE 905390 12/1986
DE 3739702 6/1989
(Continued)

OTHER PUBLICATIONS

Removable Climbing Hold Bracket (No Hold), Atomik Climbing Holds, dated May 5, 2016, 1 page, retrieved from the internet: https://www.atomikclimbingholds.com/removable-climbing-hold (Year: 2016).

(Continued)

*Primary Examiner* — Joshua T Kennedy
(74) *Attorney, Agent, or Firm* — McAndrews, Held & Malloy, Ltd.

(57) ABSTRACT

The present invention is directed to a climbing wall comprising one or more expandable climbing panels. The expandable climbing panel may be configured so that changing the angle of a portion of the climbing wall in one direction causes the climbing panel to expand, such that the panel provides an increased climbing surface area, and changing the angle of the portion of the climbing wall in the other direction causes the climbing panel to contract, such that the panel provides a reduced climbing surface area. By hingedly attaching the expandable climbing panel to first and second wall portions, at least one of which is adjustable to a plurality of angles, a climbing wall that can be brought into a variety of different configurations, e.g. at the touch of a button, is produced.

6 Claims, 22 Drawing Sheets

Related U.S. Application Data

(60) Provisional application No. 62/970,942, filed on Feb. 6, 2020.

(56) References Cited

U.S. PATENT DOCUMENTS

| | | | | |
|---|---|---|---|---|
| 6,231,482 | B1 | 5/2001 | Thompson | |
| 6,551,215 | B1 | 4/2003 | Gordon | |
| 6,860,836 | B1 | 3/2005 | Wu | |
| 6,872,167 | B1 | 3/2005 | Meissner | |
| 7,195,582 | B2 | 3/2007 | Wu | |
| 7,686,739 | B2 | 3/2010 | Vanamo | |
| 7,727,118 | B1 | 6/2010 | McCall | |
| 7,731,632 | B2 | 6/2010 | Wu | |
| 7,762,928 | B2 | 7/2010 | Meissner | |
| 8,668,626 | B1 | 3/2014 | Horowitz et al. | |
| 9,017,224 | B1 | 4/2015 | Singley | |
| 9,132,330 | B2 | 9/2015 | Brendle | |
| 9,600,716 | B2 | 3/2017 | Skjaerseth et al. | |
| 10,232,243 | B2 | 3/2019 | Bowers | |
| 10,918,925 | B2 | 2/2021 | Sudeith et al. | |
| 2002/0169052 | A1 | 11/2002 | Godsey | |
| 2003/0228956 | A1 | 12/2003 | Paci | |
| 2004/0229732 | A1 | 11/2004 | Wang et al. | |
| 2008/0293547 | A1 | 11/2008 | Moy et al. | |
| 2013/0324383 | A1 | 12/2013 | Rogers | |
| 2014/0200122 | A1 | 7/2014 | Hallmark | |
| 2019/0009157 | A1 | 1/2019 | Sudeith et al. | |
| 2020/0023257 | A1 * | 1/2020 | Speed | A63B 69/0048 |
| 2020/0114190 | A1 | 4/2020 | Tuller | |
| 2021/0275888 | A1 | 9/2021 | Speed | |

FOREIGN PATENT DOCUMENTS

| | | | | |
|---|---|---|---|---|
| DE | 102005063225 | | 6/2007 | |
| DE | 202007014591 | | 3/2008 | |
| ES | 2208074 | | 6/2004 | |
| FR | 2613945 | | 10/1988 | |
| FR | 2682606 | | 4/1993 | |
| FR | 2744638 | | 8/1997 | |
| FR | 2977501 | | 1/2013 | |
| WO | 1989009635 | | 10/1989 | |
| WO | 9108806 | | 6/1991 | |
| WO | WO-9531257 | A1 * | 11/1995 | A63B 69/0048 |

OTHER PUBLICATIONS http://edgiegear.com/flat-face-4-with-hand-hold/.
https://s-media-cache-ak0.pinimg.com/736x/d0/74/04/d074048fb21cf789b1b80f19996c805c.jpg.
http://www.top30climbingwalls.com/climbing-walls-around-the-world-climbingwalls-climbing-walls/accessories/rock—home_1103_80_1108_0_1_in.html.
https://s-media-cache-ak0.pinimg.com/originals/f6/68/f3/f668f34dae7ba1bb52a5eccedacc00f5.jpg.
http://www.supertopo.com/photos/1/82/139698_19584_L.jpg.
Vertical Solutions' (ATP) Adjustable Training Platform, by Vertical Solutions, May 9, 2018, 3 pages.
"IFSC Collaborated Field of Play Ready for Route-Setters This Summer", Entre-Prises—Climbing Walls & Holds Manufacturer, https://epclimbing,com/na/en/, 6 pages.
https://web.archive.org/web/20200505203618/https:/grasshopperclimbing.com.

* cited by examiner

EXPANDABLE CLIMBING PANEL AND CLIMBING WALL HAVING SUCH A PANEL

The present application is a continuation of U.S. patent application Ser. No. 17/167,813, filed on Feb. 4, 2021, which claims priority to U.S. Provisional Patent Application No. 62/970,942, filed on Feb. 6, 2020, the entirety of each of which is incorporated by reference herein.

SUMMARY OF THE INVENTION

Embodiments of the present disclosure are directed to an expandable climbing panel for incorporation into a climbing wall and a climbing wall comprising an expandable climbing panel.

The expandable climbing panels disclosed herein provide wall designers with the ability to design and install climbing walls that can be brought into a variety of configurations. By using these climbing walls, climbing facilities such as climbing gyms and the like may continuously provide climbers with new and interesting climbing challenges. Specifically, a climbing gym may change the orientation of a climbing wall without the need for rebuilding or replacing wall sections, which is both costly and typically requires partial closures (and thus rarely done). Using embodiments of the present invention, a climbing facility may convert a climbing wall from a first orientation into a second orientation in a matter of minutes, without any need for extended delays or closures. By installing a single climbing wall of the sort described herein, therefore, a climbing facility could provide climbers with a significantly different climbing experience on a daily, weekly, or monthly basis. Further, in some embodiments, a number of climbing walls located at different facilities, e.g. different locations of a climbing gym chain, could be placed in the same orientation in order to allow for inter-location challenges, competitions, record-keeping, and the like.

Embodiments of the present disclosure are directed to an expandable climbing panel. The expandable climbing panel may comprise an outer element and an inner element. Each of the outer element and the inner element may include a climbing panel supported by a frame. Each frame may have a track element. For instance, the outer element may have a first track element and the inner element may have a second track element. The first and second track elements are configured to interact with one another to produce a sliding motion, i.e. to slide relative to one another. Through that sliding motion, the expandable climbing panel may be moved between a retracted (i.e. closed) position and an extended (i.e. open) position. More specifically, the first and second track elements may be configured to slide relative to one another such that the climbing panel of the inner element slides behind the climbing panel of the outer element.

Where the inner element is positioned behind the outer element, as described above, the expandable climbing panel is said to be in a retracted or closed position. When the inner element is slid away from and positioned beyond the outer element, on the other hand, the expandable climbing panel is said to be in an expanded or open position. When in the expanded position, the surface area of the climbing panel of the inner element that is exposed to a user is increased. This provides the panel with a larger overall climbing surface, i.e. a climbing surface having a greater overall surface area, than that provided when the panel is in a retracted position.

Embodiments of the expandable climbing panel may also be incorporated into a climbing wall such that expansion and retraction of the expandable climbing panel provides the climbing wall with different climbing orientations, and thus different climbing challenges.

In some embodiments, for instance, the expandable climbing panel may be hingedly attached to adjacent climbing wall panels. For instance, one of the inner element and the outer element may be hingedly attached to a first wall portion and the other of the inner element and the outer element may hingedly attached to a second wall portion. At least one of the first and second wall portions may comprise an actuator that is operable to change the angle of that wall portion with respect to a vertical axis. In some embodiments, the first wall portion may comprise a first actuator and the second wall portion may comprise a second actuator, such that the angles of the first wall portion and second wall portion can be independently controlled.

Because the inner and outer elements of the expandable climbing panel are hingedly attached to the first and second wall portions, changing the angle of either wall portion relative to the other causes either (a) the inner element to slide away from the outer element, increasing an area of the climbing panel of the inner element that is exposed to a user or (b) the inner element to slide behind the outer element, decreasing the area of the climbing panel of the inner element that is exposed to a user. For instance, by increasing the variance in angle between the first and second wall portions, the expandable wall panel may be expanded. By decreasing the variance in angle between the first and second wall portions, the expandable wall panel may be retracted.

At the same time, movement of one or more of the first and second wall portions may cause the expandable wall panel to pivot about its hinges, i.e. about the hinged connection between the inner or outer element and the first wall portion, about the hinged connection between the inner or outer element and the second wall portion, or a combination thereof. By using an actuator (or actuators) to move one or more of the first wall portion and the second wall portion, one can create a climbing wall having continuous climbing surface that is defined by a first climbing segment (provided by the first wall portion), a second climbing segment (provided by the second wall portion), and a third climbing segment (provided by the expandable climbing panel). The angle of the third climbing segment relative to the first and second climbing segments may be selected from within a permitted range by control of the one or more actuators.

In some embodiments, a plurality of expandable climbing panels can be incorporated into a single climbing wall, thereby providing a structure having a continuous climbing surface that can be placed into an almost-endless variety of different configurations.

Embodiments of the present disclosure are also directed to a compound expandable climbing panel, in which first and second expandable climbing panels are linked together to provide an even greater range of potential climbing configurations. The compound expandable climbing panel may comprise a first expandable climbing panel such as that described above and a second expandable climbing panel such as that described above. However, one of the inner element and the outer element of the first expandable climbing panel is hingedly attached to one of the inner element and the outer element of the second expandable climbing panel.

In some embodiments, the hinged connection between the first expandable climbing panel and the second expandable climbing panel may span an entire edge of each panel, such that the outer or inner element of the first expandable panel that is hingedly attached to the second expandable climbing panel is not also hingedly attached to any other wall portion.

In other embodiments, however, that hinged connection may only span a portion of an edge of one of the panels. For instance, in some embodiments, the outer or inner element of the first expandable panel that is hingedly attached to the second expandable climbing panel may also be hingedly attached to a non-expandable wall panel, e.g. a first wall portion. Further, the outer or inner element of the second expandable wall panel that is not hingedly attached to the first expandable climbing panel may be hingedly attached to a non-expandable wall panel, e.g. a second wall portion. And the second wall portion may be hingedly attached to the first wall portion. In some embodiments, for instance, the second wall panel may be positioned vertically upward of the first wall portion. In such an embodiment, the compound expandable climbing panel provides a climbing wall with a multitude of different climbing configurations and challenges.

The compound expandable climbing panels may be operated in a number of different ways. In some embodiments, for instance, an actuator associated with an adjacent wall portion may be used to control the expansion and retraction (and the associated pivoting about its hinged connections) of both the first expandable climbing panel and the second expandable climbing panel. In other embodiments, a first actuator associated with an adjacent wall portion may be used to control the expansion and retraction (and the associated pivoting about its hinged connections) of the first expandable climbing panel and a second actuator associated with an adjacent wall portion may be used to independently control the expansion and retraction (and the associated pivoting about its hinged connections) of the second expandable climbing panel. In yet other embodiments, a first actuator may be used to control both the first and second expandable climbing panels and a second actuator may be used to provide additional control over one of the first and second expandable climbing panels (similarly, a third actuator could provide additional control over the other of the first and second expandable climbing panels).

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1:
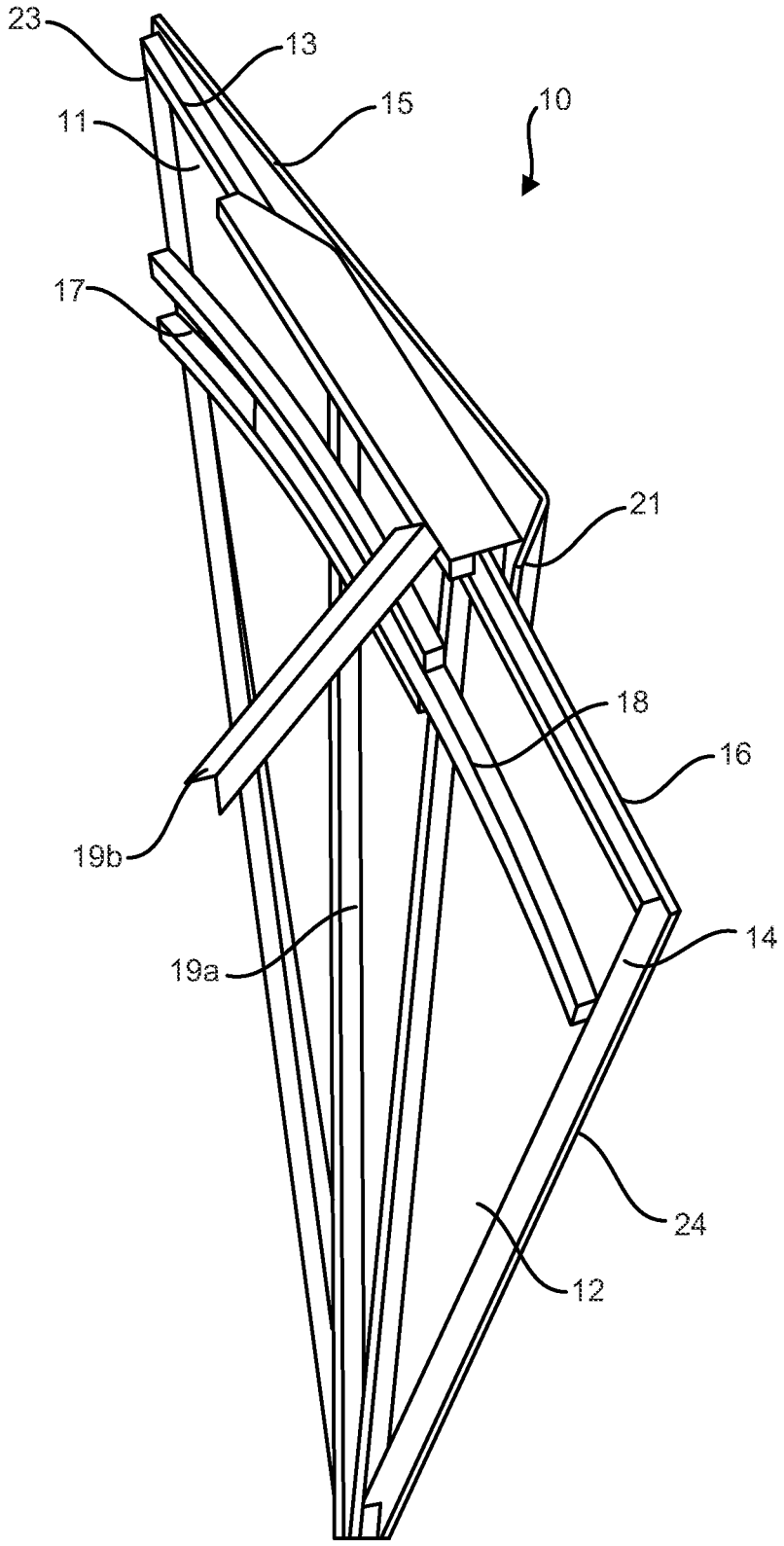
FIG. 1 is a rear perspective view of an expandable climbing panel in accordance with an embodiment of the present disclosure.

Embodiments of the present disclosure are directed to expandable climbing panels 10. An example of an expandable climbing panel 10 is shown in FIGS. 1 through 6. The expandable climbing panel 10 comprises an outer element 11 and an inner element 12. The outer element 11 comprises a frame 13 and a climbing panel 15. Similarly, the inner element 12 comprises a frame 14 and a climbing panel 16.

Each of climbing panels 15, 16 are configured to releasably receive a plurality of climbing grips (non-illustrated). For example, each of climbing panels 15, 16 may have a plurality of apertures arranged in a pattern, each of the apertures being designed to receive any number of conventional climbing grips.

Figure 5:
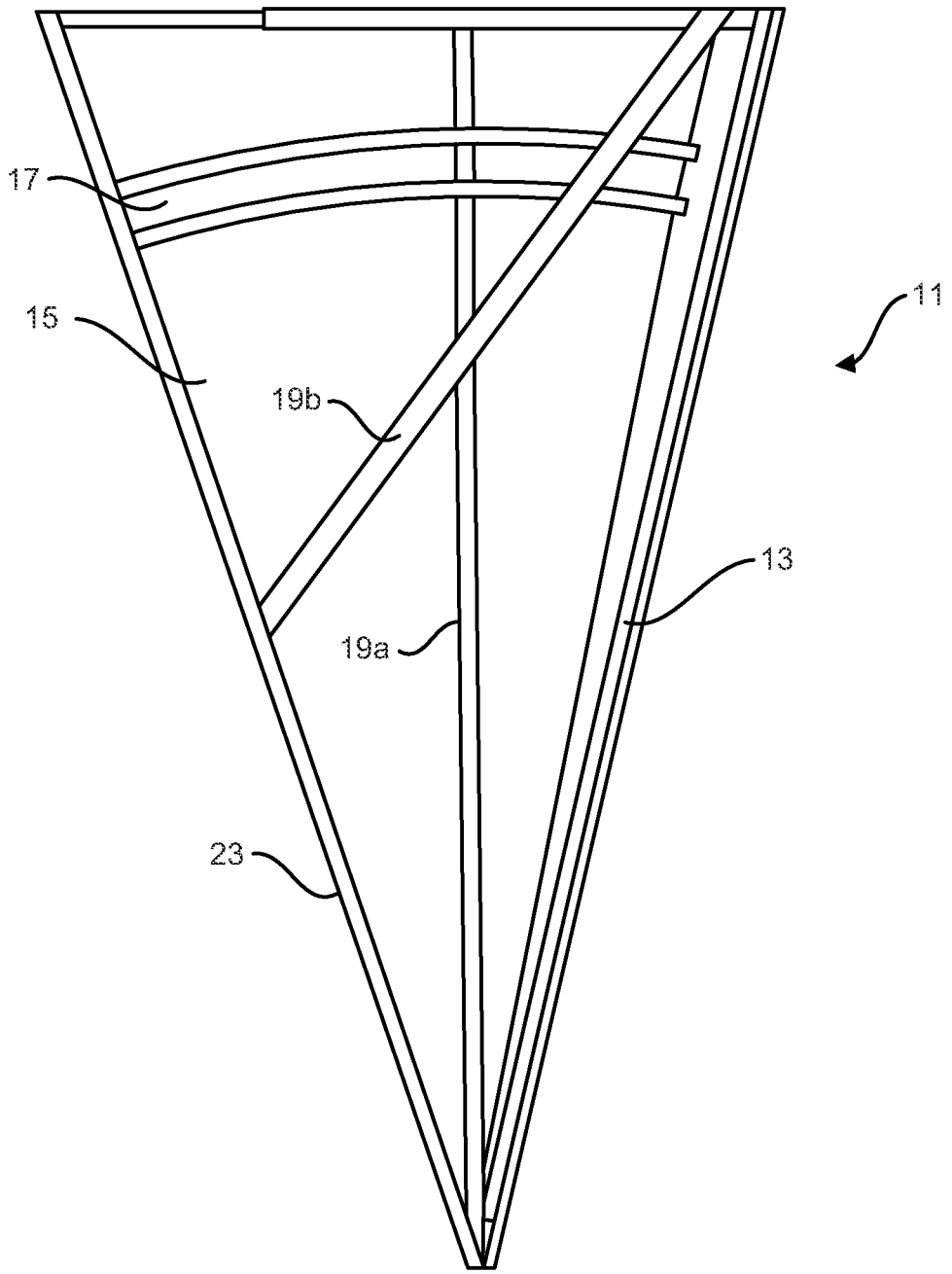
FIG. 5 is a rear elevation view of the outer element of the expandable climbing panel shown in FIG. 1.
Figure 6:
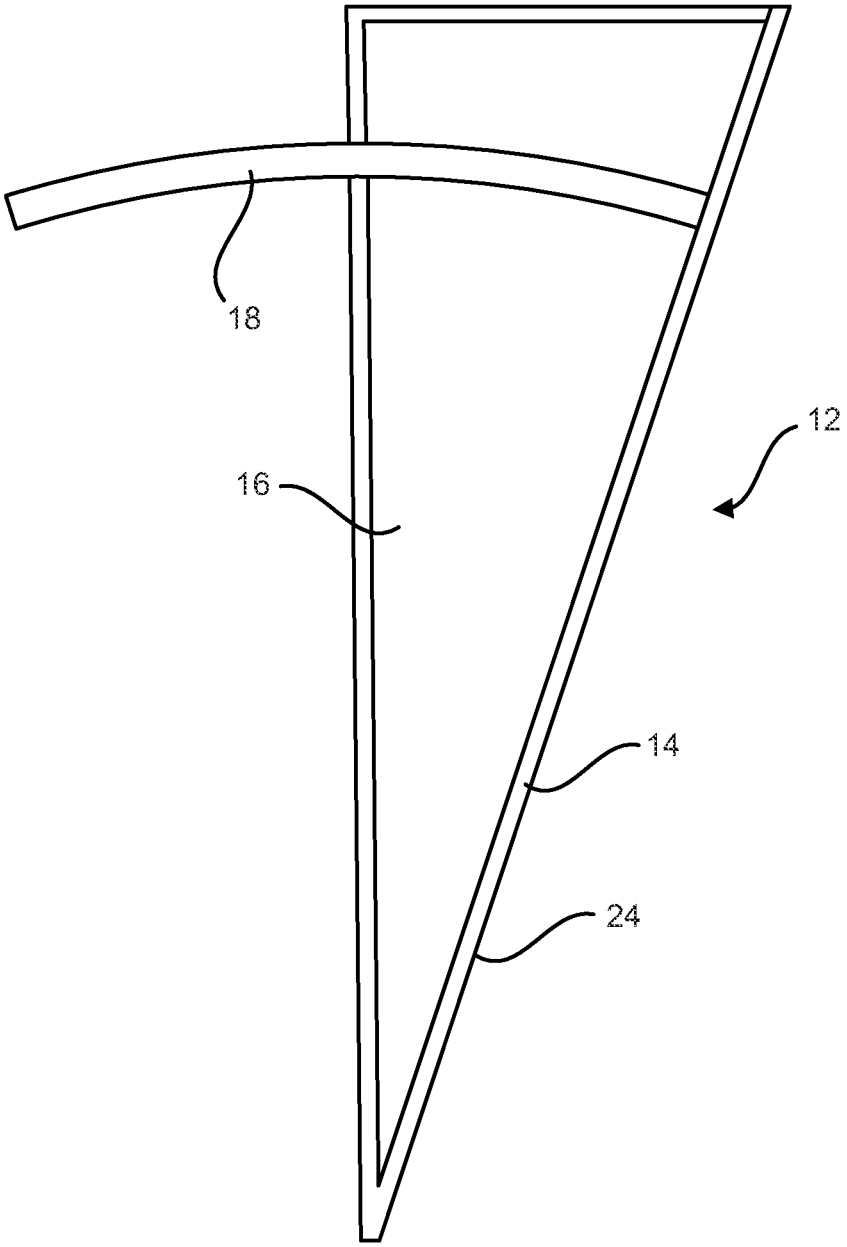
FIG. 6 is a rear elevation view of the inner element of the expandable climbing panel shown in FIG. 1.

Each frame 13, 14 provides structural support for its associated climbing panel 15, 16. Accordingly, each frame 13, 14 may generally comprise support members around the periphery of the associated climbing panel 15, 16. Each frame 13, 14 may also include any additional structural support elements as may be needed to provide the expandable climbing panel 10 with sufficient structural support. As best seen in FIG. 5, for instance, the outer element 11 of the illustrated embodiment comprises additional support members 19*a* and 19*b*.

Each of the outer element 11 and the inner element 12 also comprises a track element configured to slidably interact with the track element of the other element. More particularly, for instance, frame 13 comprises a first track element 17 and frame 14 comprises a second track element 18. The track elements 17, 18 are configured to slide relative to one another. In the illustrated embodiments, for instance, track 18 is configured to slide within the passageway formed by track 17. However, any other track configuration suitable to provide the desired sliding motion, as could be identified by a person of ordinary skill in the art in view of the present disclosure, is also contemplated without departing from the scope of the present invention. As one example, each track 17, 18 could comprise a tubular element, with the cross-section of one of the tubular elements being smaller than the cross-section of the other tubular element so as to allow for telescoping of one tubular element within the other.

Figure 2:
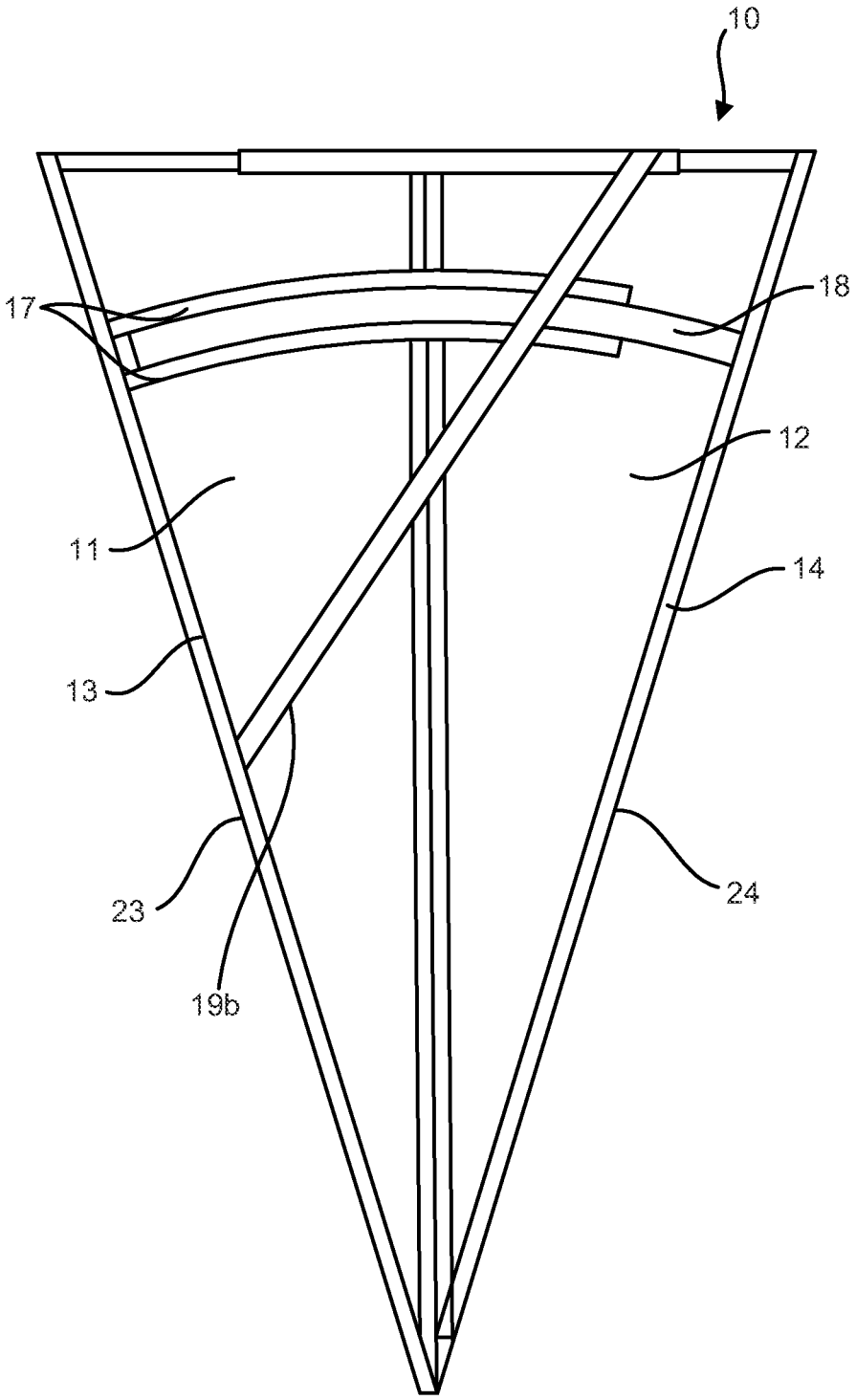
FIG. 2 is a rear elevation view of the expandable climbing panel shown in FIG. 1, with the inner element being in a retracted position.
Figure 3:
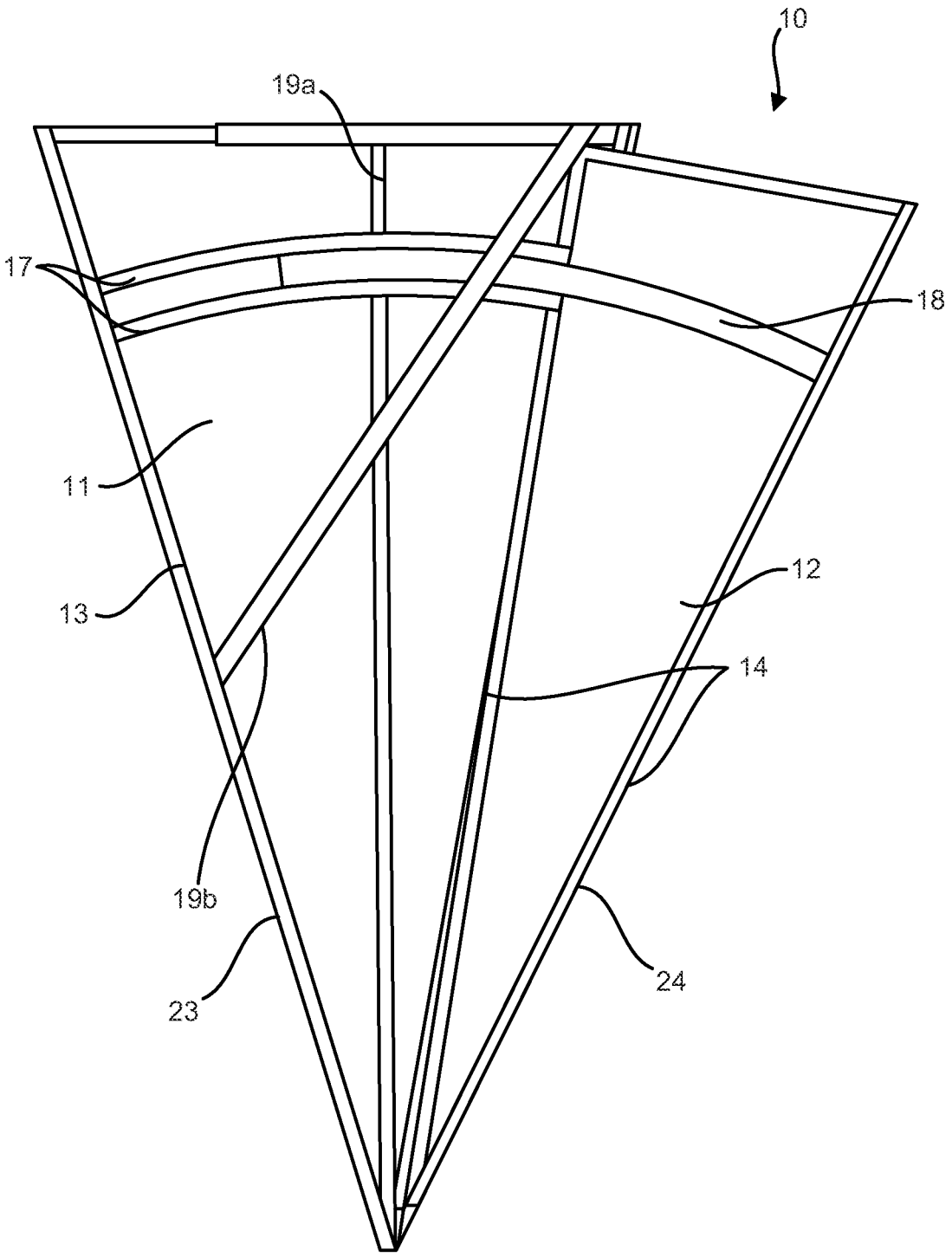
FIG. 3 is a rear elevation view of the expandable climbing panel shown in FIG. 1, with the inner element being in an expanded position.

As can be seen in FIG. 2, when track 18 is slid into track 17, at least a portion of the inner element 12—and in particular at least a portion of the climbing panel 16 of inner element 12—is moved behind the climbing panel 15 of outer element 11. This brings the expandable climbing panel 10 to a retracted, or closed, position. As can be seen in FIG. 3, when track 18 slides away from track 17, a portion of the inner element 12—and in particular a portion of the climbing panel 16 of inner element 12—is moved out from behind the climbing panel 15 of outer element 11. This brings the expandable climbing panel 10 to an expanded, or open, position. In an expanded position, the surface area of climbing panel 16 that is exposed to a user is greater than the surface area of climbing panel 16 that is exposed when the expandable climbing panel 10 is in a retracted position. In that way, the total climbing surface of the expandable climbing panel 10 is increased.

In order to facilitate the sliding movement between tracks 17, 18, at least one of tracks 17, 18 may be provided with one or more friction reducers. For example, in some embodiments, at least one of tracks 17, 18 may be provided with one or more wheels, ball bearings, roller slides, or the like. In other embodiments, at least one of tracks 17, 18 may be provided with a friction-reducing coating.

In addition to facilitating the sliding movement between tracks 17, 18, however, it may also be necessary to ensure that the tracks do not unintentionally move during a climbing activity, e.g. when a climber exerts a force on one of climbing panels 15, 16. In order to provide the climbing panel 10 with enhanced stability against unintentional movements, the expandable climbing panel may also include a brake that is configured to secure the first and second track elements 17, 18 in a set position so as to prevent undesired movement of either track during a climbing activity. The brake may take on any form, as would be understandable to a person of ordinary skill in the art. For instance, the brake may comprise an electronic braking mechanism, a pneumatic braking mechanism, or a manual braking mechanism.

In some embodiments, including the illustrated embodiments, the expandable climbing panel 10 is not limited to movement between a closed position and any single expanded position. Rather, expansion of the climbing panel 10 may be stopped at any (expanded) position between (a) the closed position and (b) a fully expanded position, in which track 17 is extended away from track 18 to its maximum allowed extent. In other words, there is a continuous range of expanded positions that can be selected. In this way, the expandable climbing panel 10 can be provided with climbing surface areas within a continuous range.

In other (non-illustrated) embodiments, the expandable climbing panel 10 may be limited to one or more predefined expanded positions. For instance, the expandable climbing panel 10 may be expanded only to one, two, three, four, etc. positions. In those embodiments, for instance, expansion of the climbing panel 10 may only be stopped at predefined points between the closed position and a fully expanded position. For instance, tracks 17, 18 may be provided with a ratcheting movement. One benefit of such an approach would be to provide the tracks 17, 18 with enhanced stability when placed in one of the predefined positions, e.g. so as to prevent undesirable movement of the inner element 12 relative to the outer element 11 during a climbing activity without using a brake.

In some embodiments, such as the illustrated embodiment, the space between the climbing panel 16 of inner element 12 and outer element 11 may be minimized in order to prevent a climber from using any seam between the two as a climbing grip. In order to minimize the space between the climbing panel 16 and the outer element 11, the expandable climbing panel 10 may be configured such that any attached climbing grips must be removed in order for the climbing panel 16 of the inner element 12 to slide behind the climbing panel 15 of the inner element 11, i.e. prior to bringing the expandable climbing panel 10 into a retracted position.

Figure 4:
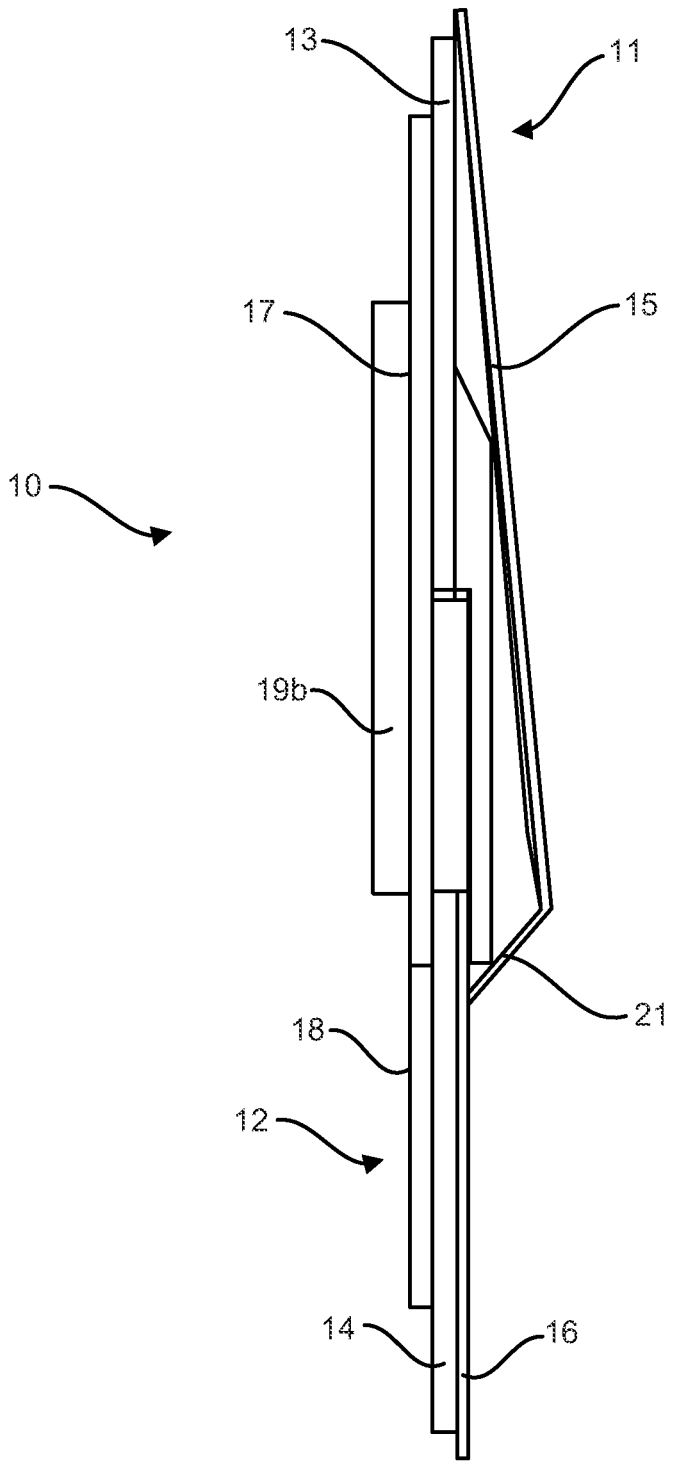
FIG. 4 is a top plan view of the expandable climbing panel shown in FIG. 1, with the inner element being in an expanded position.

Further, the climbing panel 15 of the outer element 11 may include a concealing surface 21 that is angled toward the climbing panel 16 of the inner element 12. As illustrated in FIG. 4, the end of the concealing surface 21 may be placed adjacent to the climbing panel 16 of the inner element 12, so as to prevent a climber from being able to grip the end of the concealing surface or anything located behind the concealing surface. The concealing surface 21 may be made of the same material as the remainder of climbing panel 15.

In other embodiments, the climbing panel 16 of the inner element 12 may slide behind the climbing panel 15 of the outer element 11, i.e. to bring the expandable climbing panel 10 into a retracted position, without the need to remove any climbing grips that are attached to climbing panel 16. For instance, the spacing between the climbing panel 16 of the inner element 12 and the frame 13 of the outer element 11 shown in FIG. 4 could simply be expanded to provide sufficient spacing for conventional climbing grips. The climbing panel 15 of the outer element 11 could still include a concealing surface 21, though the end of the concealing surface would have to be either separated from or movable away from the climbing panel 16 of inner element 12 by a sufficient space to allow for climbing grips attached to climbing panel 16 to travel behind it.

In general, the expandable climbing panel 10 of the present disclosure may have any number of shapes. However, in order to be easily incorporated into a climbing wall, embodiments of the expandable climbing panel 10 have the general shape of a triangle. As in the illustrated embodiment, for instance, the outer element 11 and the inner element 12 may each have the general shape of a triangle. Moreover, the tracks 17, 18 may each generally have any number of shapes, including for example linear tracks. However, to facilitate a desired movement between the outer and inner elements 11, 12, in some embodiments (including the illustrated embodiment), each of tracks 17, 18 may be shaped as the arc of a circle.

Embodiments of the present disclosure are also directed to a climbing wall 100 that incorporates an expandable climbing panel 10, such as any of those shown and/or described herein. An example of climbing wall 100 having such an expandable climbing panel 10 is shown in FIGS. 7 through 12. For reference, the climbing wall 100 is shown in both (a) a first orientation in FIGS. 7 through 9 and (b) a second orientation in FIGS. 10 through 12. However, the climbing wall 100 may also be brought to any number of additional different orientations, as described herein.

In addition to an expandable climbing panel 10, the illustrated embodiment of a climbing wall 100 comprises a first wall portion 101 and a second wall portion 102. Each of the first wall portion 101 and the second wall portion 102 comprises a framework and a climbing surface. For example, first wall portion 101 includes framework 103 and climbing surface 105. Second wall portion 102 includes framework 104 and climbing surface 106. Each of climbing surfaces 105, 106 are configured to releasably retain a plurality of climbing grips. For instance, each of climbing surfaces 105, 106 may comprise a plurality of apertures arranged in a pattern, each aperture being designed to retain any number of conventional climbing grips. Each of frames 103, 104 provide support and stability to each of climbing surfaces 105, 106.

The outer element 11 of the expandable climbing panel 10 is hingedly attached to the first wall portion 101 and the inner element 12 of the expandable climbing panel 10 is hingedly attached to the second wall portion 102. However, the orientation of the expandable climbing panel could just as easily be reversed, with the inner element 12 being hingedly attached to the first wall portion 101 and the outer element 11 being hingedly attached to second wall portion 102.

As illustrated, the hinged connection between the outer element 11 and the first wall portion 101 runs along the length (i.e. height) of the outer element. Similarly, the hinged connection between the inner element 12 and the second wall portion 102 runs along the length (i.e. height) of the inner element. More particularly, the distal side support member of the frame 13 of the outer element 11 may comprise a hinge element 23, such as a piano hinge, running along its length. Similarly, the distal side support member of the frame 14 of the inner element 12 may comprise a hinge element 24, such as a piano hinge, running along its length.

The climbing wall 100 also comprises at least one actuator or set of actuators that is operable to change an angle of one of the wall portions 101, 102. In the illustrated embodiment, for example, climbing wall 100 comprises a first set of actuators 111 (referred to as actuator 111 for simplicity) that is operable to change an angle of the first wall portion 101 with respect to a vertical axis and a second set of actuators 112 (referred to as actuator 112 for simplicity) that is operable to change an angle of the second wall portion 102 with respect to a vertical axis. The first actuator 111 and the second actuator 112 may be operated independently, such that the angle of the first wall portion 101 may be adjusted independently of the angle of the second wall portion 102, and vice versa. Operation of the actuators 111, 112 to change the angle of the first and second wall portions 101, 102 is described in detail in co-owned U.S. patent application Ser. No. 16/028,931 (published as US 2019/0009157 A1), the entirety of which is incorporated herein by reference.

As at least one of actuators 111, 112 is operated to change the angle of wall portion 101, wall portion 102, or both, the change in the relative angle between the two wall portions 101, 102 will cause either (a) the inner element 12 to slide away from the outer element 11, increasing an area of the climbing panel 16 of the inner element that is exposed to a user, or (b) the inner element 12 to slide toward the outer element 11, such that a portion of the climbing panel 16 of inner element 12 moves behind the climbing panel 15 of the outer element 11, decreasing the area of climbing panel 16 that is exposed to a user. More specifically, as the difference between the angle of first wall portion 101 and the angle of second wall portion 102 increases, the expandable wall panel 10 will be moved into an expanded position. As the difference between the angle of the first wall portion 101 and the angle of the second wall portion 102 decreases, i.e. as the two wall portions are brought together, the expandable wall panel will be moved into a retracted position.

Figure 7:
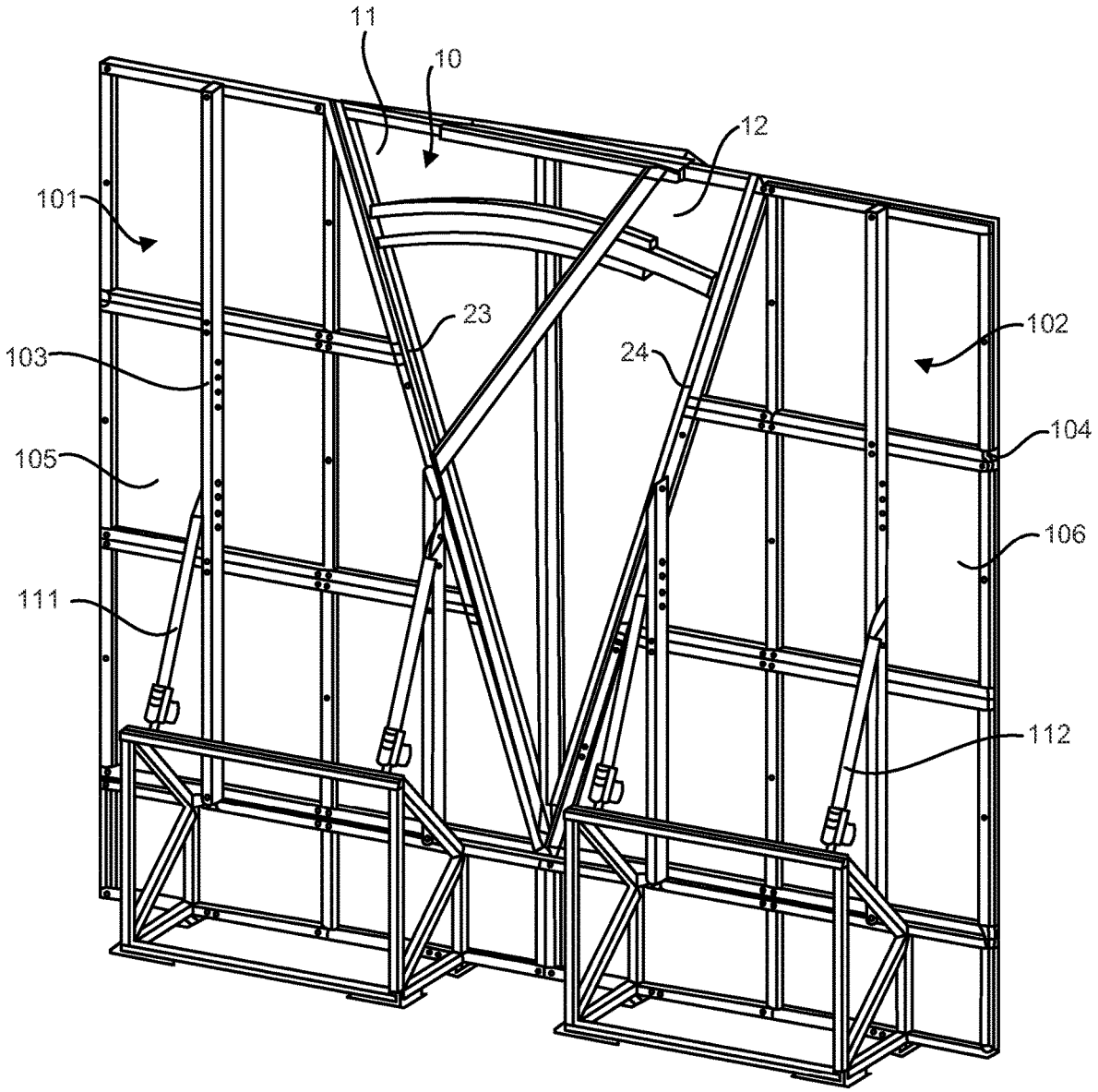
FIG. 7 is a rear perspective view of a climbing wall having an expandable climbing panel in accordance with an embodiment of the present disclosure, showing the climbing wall in a first orientation (in which the expandable climbing panel is un-expanded).
Figure 8:
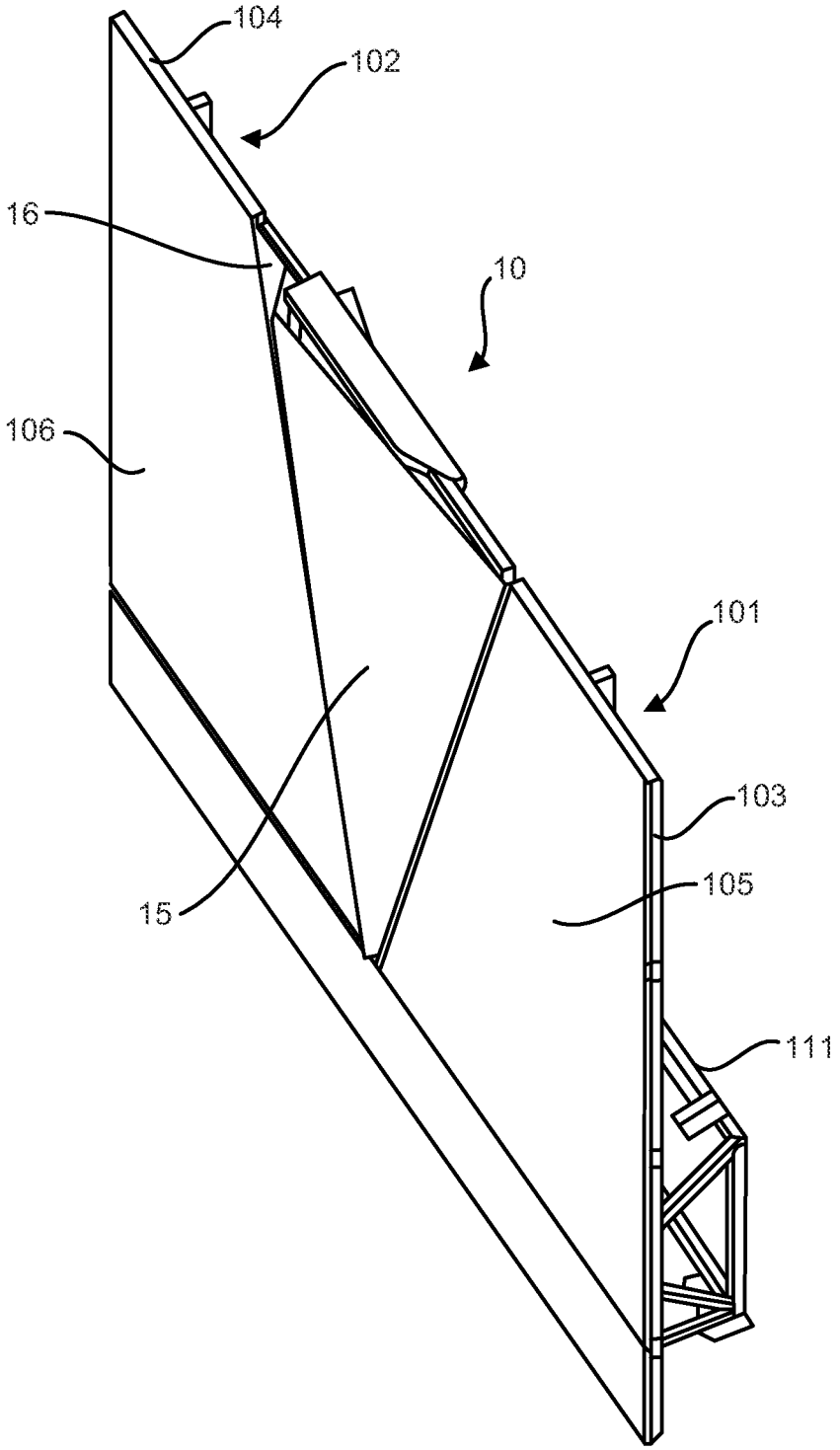
FIG. 8 is a front perspective view of the climbing wall shown in FIG. 7.
Figure 9:
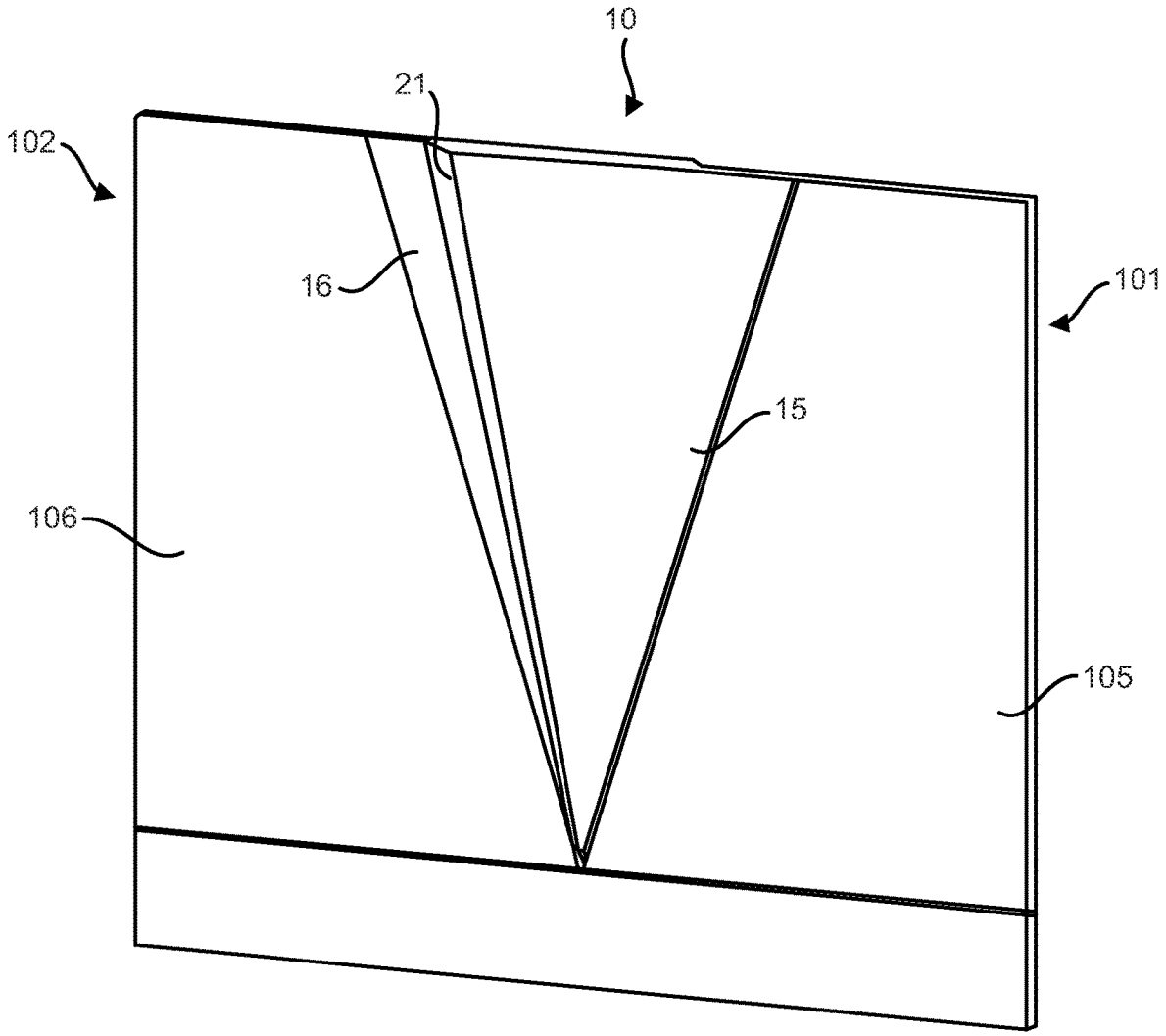
FIG. 9 is another front perspective view of the climbing wall shown in FIG. 7.
Figure 10:
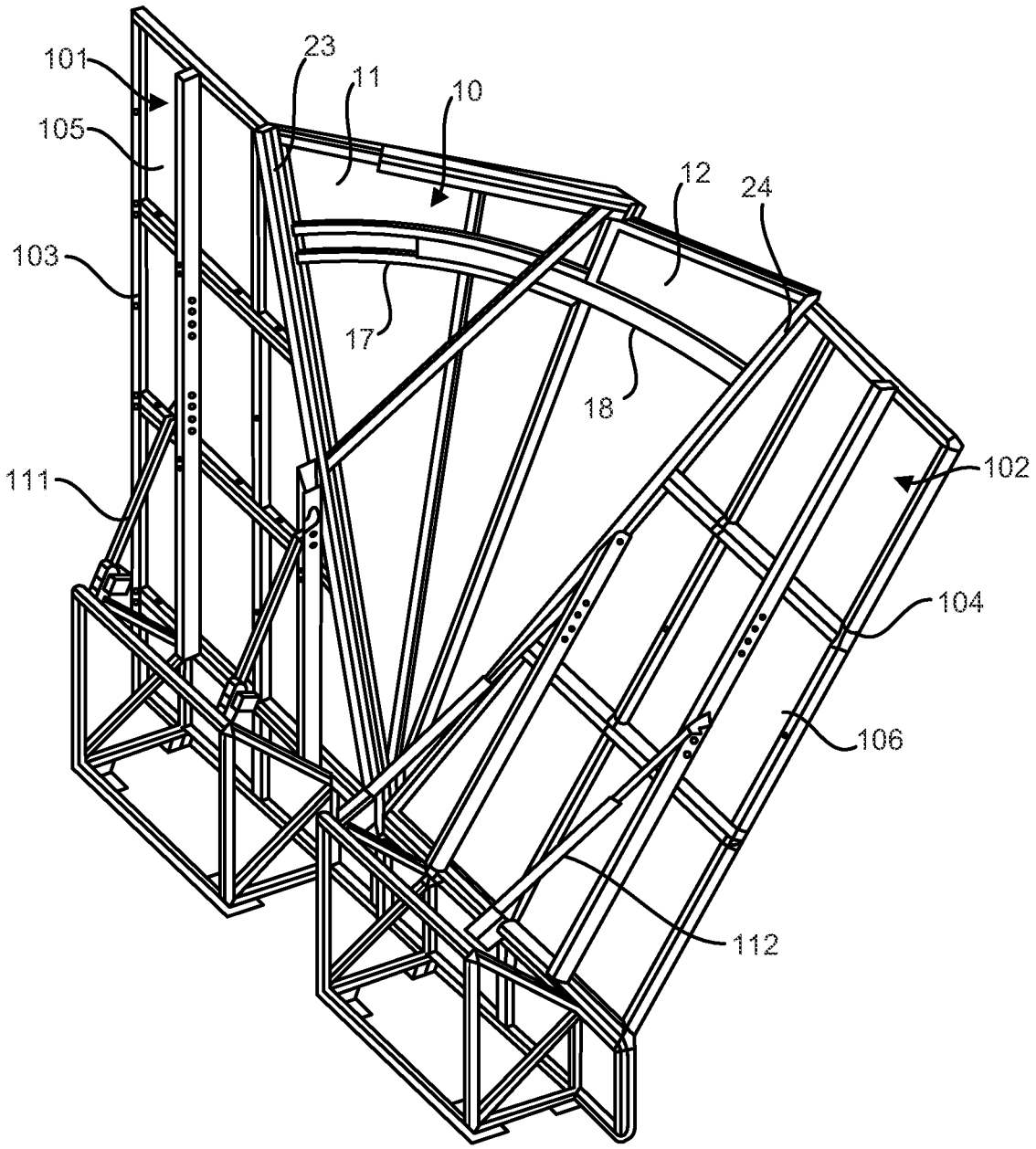
FIG. 10 is a rear perspective view of the climbing wall shown in FIG. 7, showing the climbing wall in a second orientation (in which the expandable climbing panel is expanded).
Figure 11:
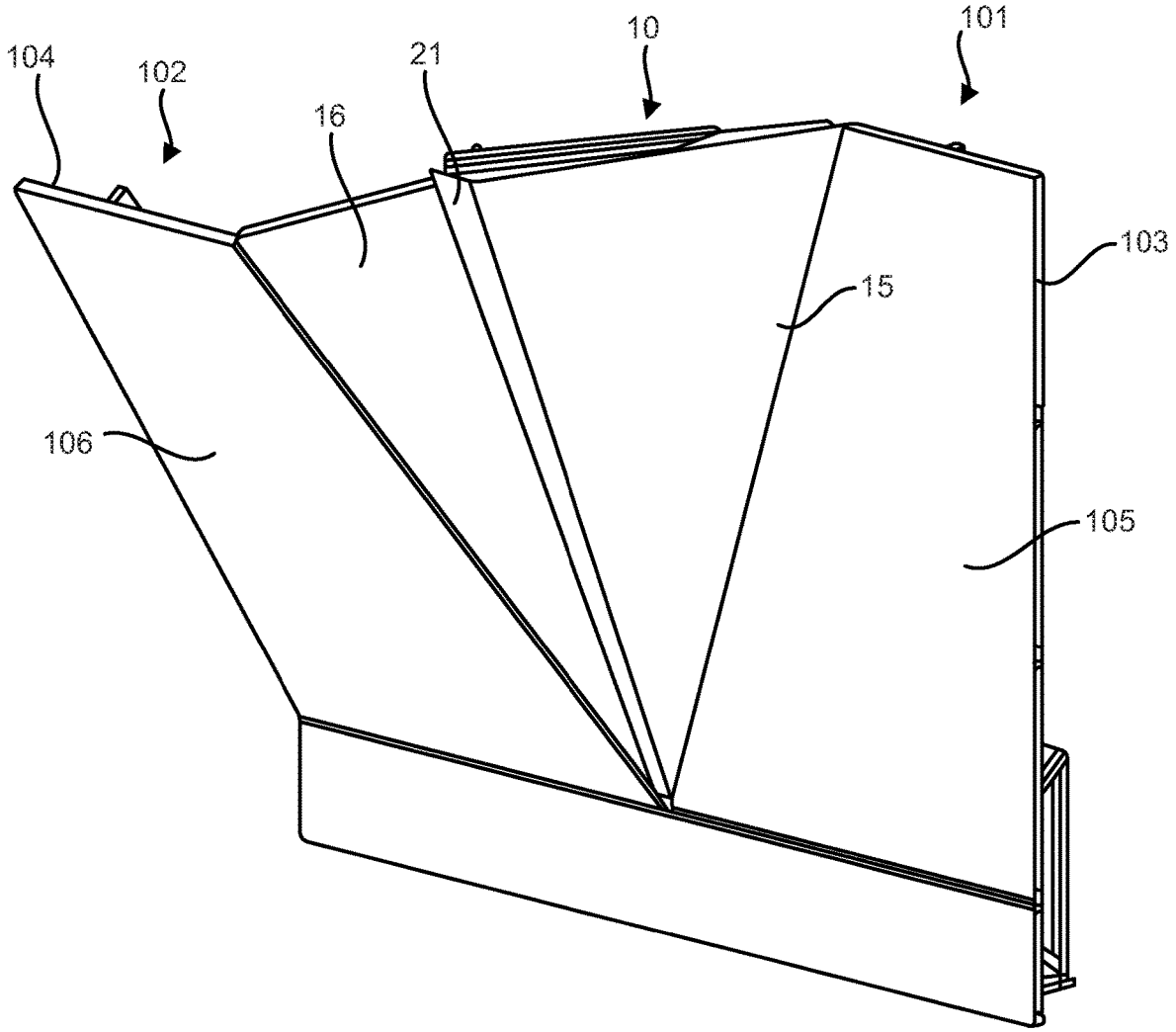
FIG. 11 is a front perspective view of the climbing wall shown in FIG. 10.
Figure 12:
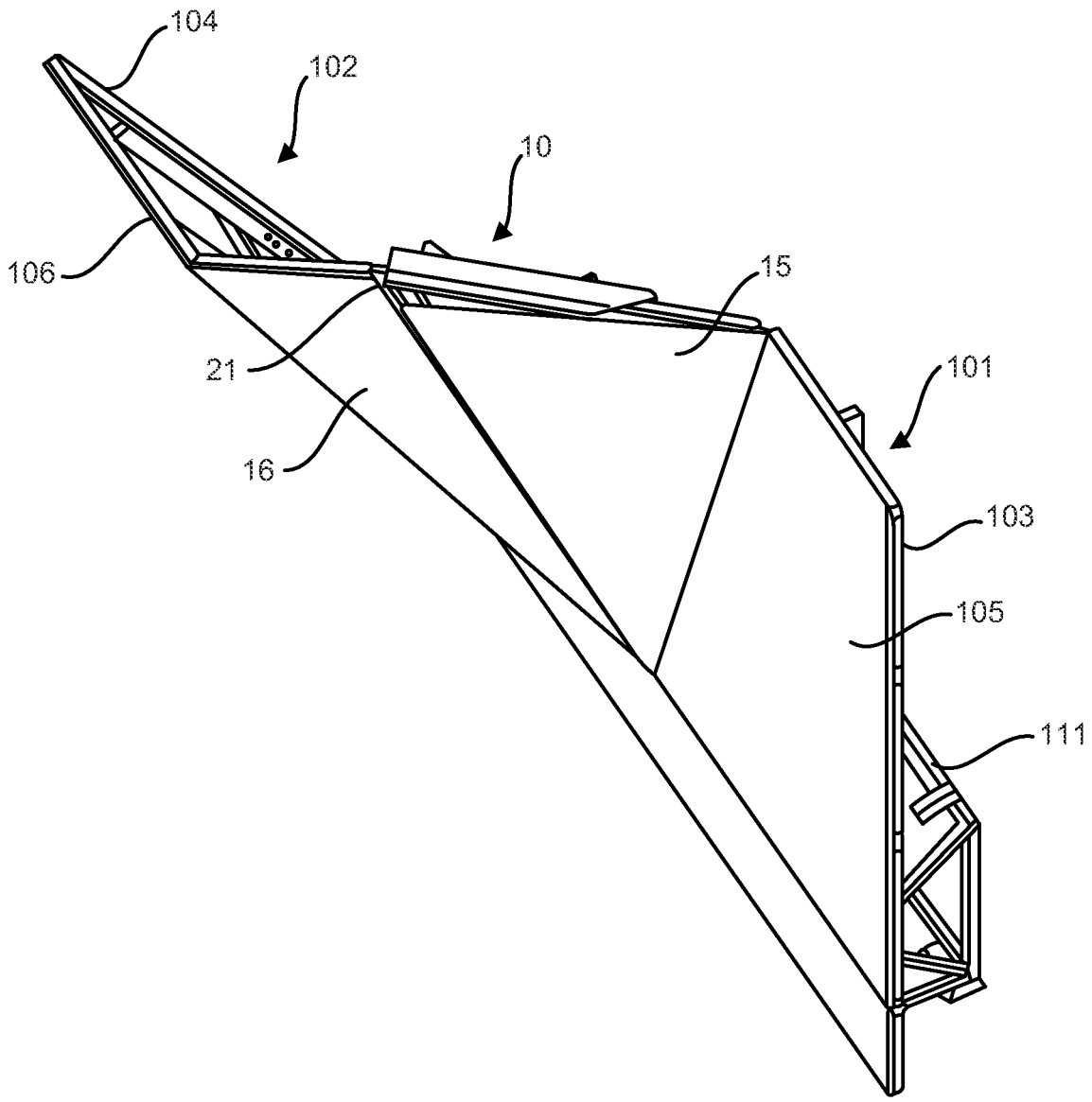
FIG. 12 is another front perspective view of the climbing wall shown in FIG. 10.

This can be seen for example by comparing FIGS. 7-9 with FIGS. 10-12. In FIGS. 7-9, the first wall portion 101 and the second wall portion 102 are each positioned vertically (i.e. at an angle of 0° with a vertical axis). And expandable climbing panel 10 is in its retracted position. In FIGS. 10-12, on the other hand, actuator 112 has been operated so as to place the second wall portion 102 at an angle other than vertical. The first wall portion 101 has not been moved and thus remains in a vertical position. Accordingly, the difference in angle between the first wall portion 101 and the second wall portion 102 has been increased. This has moved the expandable climbing panel 10 into an expanded position.

More particularly, movement of the second wall portion 102 into an angled, i.e. non-vertical, orientation causes a number of things to occur. First, it causes track 18 of inner element 12 to slide away from track 17 of outer element 11, bringing the expandable climbing panel 10 into an expanded position. Second, it causes both (a) the outer element 11 to pivot via its hinged connection 23 with the first wall portion 101 and (b) the inner element 12 to pivot via its hinged connection 24 with the second wall portion 102. This creates a climbing surface having three distinct segments, each of which is angled with respect to one another.

In both orientations, the climbing wall 100 provides a continuous climbing surface made up of climbing panels 105, 15, 16, and 106. However, the surface area of the climbing surface has been increased when the climbing wall 100 is moved into the orientation shown in FIGS. 10-12. Moreover, by moving just one of the wall portions 101, 102, the climbing wall 100 has been provided with a more challenging climbing surface made up of segments having an angled relationship to one another. The exact angled relationship may be selected by control over the one or more actuators.

For instance, the second wall portion 102 may be brought to a greater or lesser angle with respect to vertical, thereby changing the angular relationship between the expandable climbing panel 10 and the first and second wall portions 101, 102. Moreover, though not illustrated, the actuator 111 associated with the first wall portion 101 could also be operated to place the first wall portion at an angled, i.e. non-vertical position. This too, would change the angular relationship between the climbing panel 10 and the first and second wall portions 101, 102. Simply by controlling the two actuators 111, 112, a variety of different climbing configurations may easily be obtained.

Further, in contrast to the illustrated embodiment, the retracted position of the expandable climbing panel 10 need not correspond with the adjacent wall portions 101, 102 both being in a vertical orientation. Rather, in some embodiments, the expandable climbing panel 10 may be in a retracted position when one or more of the adjacent wall portions 101, 102 is angled other than vertical (either positively or negatively).

In some embodiments, a plurality of expandable climbing panels 10 can be incorporated into a single climbing wall 100, thereby providing a structure having a continuous climbing surface that can be placed into an almost-endless variety of different configurations. An example of a climbing wall 100 comprising a plurality of expandable climbing panels 10 is shown in FIG. 13.

Figure 13:
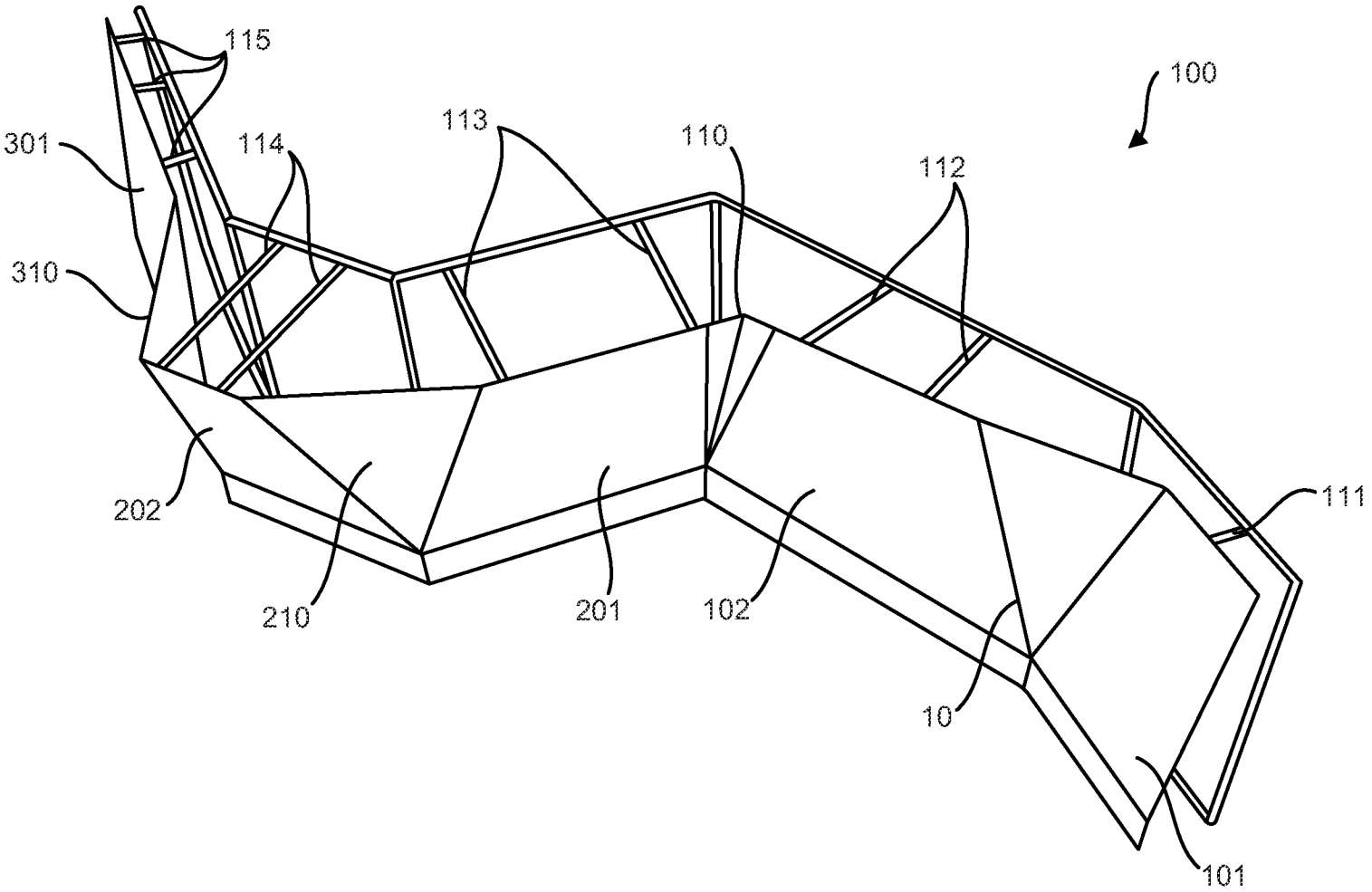
FIG. 13 is a top perspective view of a climbing wall having a plurality of expandable climbing panels in accordance with an embodiment of the present disclosure.

As shown in FIG. 13, climbing wall 100 comprises a first expandable panel 10, a second expandable panel 110, a third expandable panel 210, and a fourth expandable panel 310. Each expandable panel 10, 110, 210, 310, is separated hingedly attached to adjacent wall portions. Specifically, expandable panel 10 is hingedly attached to first wall portion 101 and second wall portion 102, expandable panel 110 is hingedly attached to second wall portion 102 and third wall portion 201, expandable panel 210 is hingedly attached to third wall portion 201 and fourth wall portion 202, and expandable panel 310 is hingedly attached to fourth wall portion 202 and fifth wall portion 301. Moreover, each wall portion 101, 102, 201, 202, 301, is associated with an actuator that is operable to move the wall portion within a range of angles, thereby expanding or retracting each associated expandable climbing panel 10, 110, 210, 310. Specifically, for example, first wall portion 101 may be moved within a range of angles by actuator 111, second wall portion 102 may be moved within a range of angles by actuator set 112, third wall portion 201 may be moved within a range of angles by actuator set 113, fourth wall portion 202 may be moved within a range of angles by actuator set 114, and fifth wall portion 301 may be moved within a range of angles by actuator set 115.

Also as shown in FIG. 13, in contrast to the specific actuator attachment mechanism shown in FIGS. 7-12, each actuator may be secured to a framework that is positioned significantly higher up on a support structure. By connecting the actuators between an upper region of the climbing wall 100 and a support structure at a similar height, the stability of the climbing wall 100 may be increased (though the footprint of the climbing wall will also be increased).

Embodiments of the present disclosure are also directed to a compound expandable climbing panel 500. A first example of climbing wall 100 having a compound expandable climbing panel 500 is shown in FIGS. 14 through 19.

Embodiments of a compound expandable climbing panel 500 comprise a first expandable climbing panel 501 and a second expandable climbing panel 502. The first expandable climbing panel 501 may have an outer element 511 and an inner element 512 that move relative to one another as described above. The second expandable climbing panel 502 may also have an outer element 521 and an inner element 522 that move relative to one another as described above. Notably, in a compound expandable climbing panel 500, the first expandable climbing panel 501 is hingedly attached to the second expandable climbing panel 502. More specifically, one of the outer element 511 and the inner element 512 of the first expandable panel 501 is hingedly attached to one of the outer element 521 and the inner element 522 of the second expandable panel 502.

In the embodiment illustrated in FIGS. 14 through 19, for example, the outer element 521 of the second expandable climbing panel 502 is hingedly attached to the inner element 512 of the first expandable climbing panel. However, the exact orientation of inner and outer elements of the compound panel 500 does not matter. For instance, instead of the illustrated orientation, outer element 521 could be hingedly attached to outer element 511, inner element 522 could be hingedly attached to inner element 512, or inner element 522 could be hingedly attached to outer element 511.

In some embodiments, the hinged connection between the first expandable climbing panel 501 and the second expandable climbing panel 502 may span the entire lengths of the edges of the two hinged elements (a) 511 or 512 and (b) 521 or 522. In other embodiments, however, including the illustrated embodiments, one or more of the elements may be hingedly attached not only to the other expandable climbing panel but also to a wall panel. For instance, the one of the outer element 511 and inner element 512 (of the first expandable climbing panel 501) that is hingedly attached to the second expandable climbing panel 502 may also be hingedly attached to a first wall panel 601. In the embodiment illustrated in FIGS. 14-19, for example, inner element 512 is hingedly attached to (a) outer element 521 of the second expandable climbing panel 502 at an upper hinge 513 and (b) first wall portion 601 at a lower hinge 514. The opposite element, in this case outer element 511, may be hingedly attached to a third wall portion 603 at hinge 515.

The second expandable climbing panel 502 may be hinged (a) to the first expandable climbing panel 501, e.g. about hinge 513, on one side and (b) to a second wall portion 602, e.g. about hinge 525. Second wall portion 602 may be adjacent to the first wall portion 601. In fact, as shown in FIGS. 14-19, second wall portion 602 may itself be hingedly attached to the first wall portion 601. The location of the second wall portion 602 relative to the first wall portion 601 may vary depending on the overall configuration of the climbing wall 100. However, in some embodiments such as that shown in FIGS. 14-19, the second wall portion 602 may be located vertically above the first wall portion 601.

The first wall portion 601, the second wall portion 602, the third wall portion 603, or any combination thereof may further comprise one or more actuators operable to change the angle of the wall portion with respect to a vertical axis. In the illustrated example, for instance, a first set of actuators 111 is configured to change the angle of the first wall portion 601 and a second set of actuators 112 is configured to change the angle of the second wall portion 602. Although not illustrated, there could also be a third actuator (or set of actuators) configured to change the angle of the third wall portion 603.

Each actuator may be attached to a support structure 700 positioned behind the climbing wall 100. The support structure 700 may take on any configuration, so long as it provides sufficient structural support for the climbing wall 100.

Depending on the placement of the compound expandable climbing panel 500 relative to wall portions 601, 602, 603, as well as on the range of angles within which each of the wall portions may move, the actuators may each be configured to either (a) cause expansion and retraction of both the first expandable climbing panel 501 and the second expandable climbing panel 502, (b) cause expansion and retraction of only the first expandable climbing panel 501, or (c) cause expansion and retraction of only the second expandable climbing panel 502.

In the illustrated embodiment, for instance, by moving wall portion 601 within a permitted range of angles, actuators 111 are operable to cause expansion and retraction of both the first expandable climbing panel 501 and the second expandable climbing panel 502 of the compound panel 500. However, in other embodiments, actuators 111 may only be operable to cause expansion and retraction of the first expandable climbing panel 501 of the compound panel 500. On the other hand, in the illustrated embodiment, by moving wall portion 602 within a permitted range of angles, actuators 112 are operable to cause expansion and retraction of only the second expandable climbing panel 502 of the compound panel 500. In other embodiments, however, actuators 112 may be operable to cause expansion and retraction of both expandable climbing panels 501, 502 of the compound panel 500.

Figure 14:
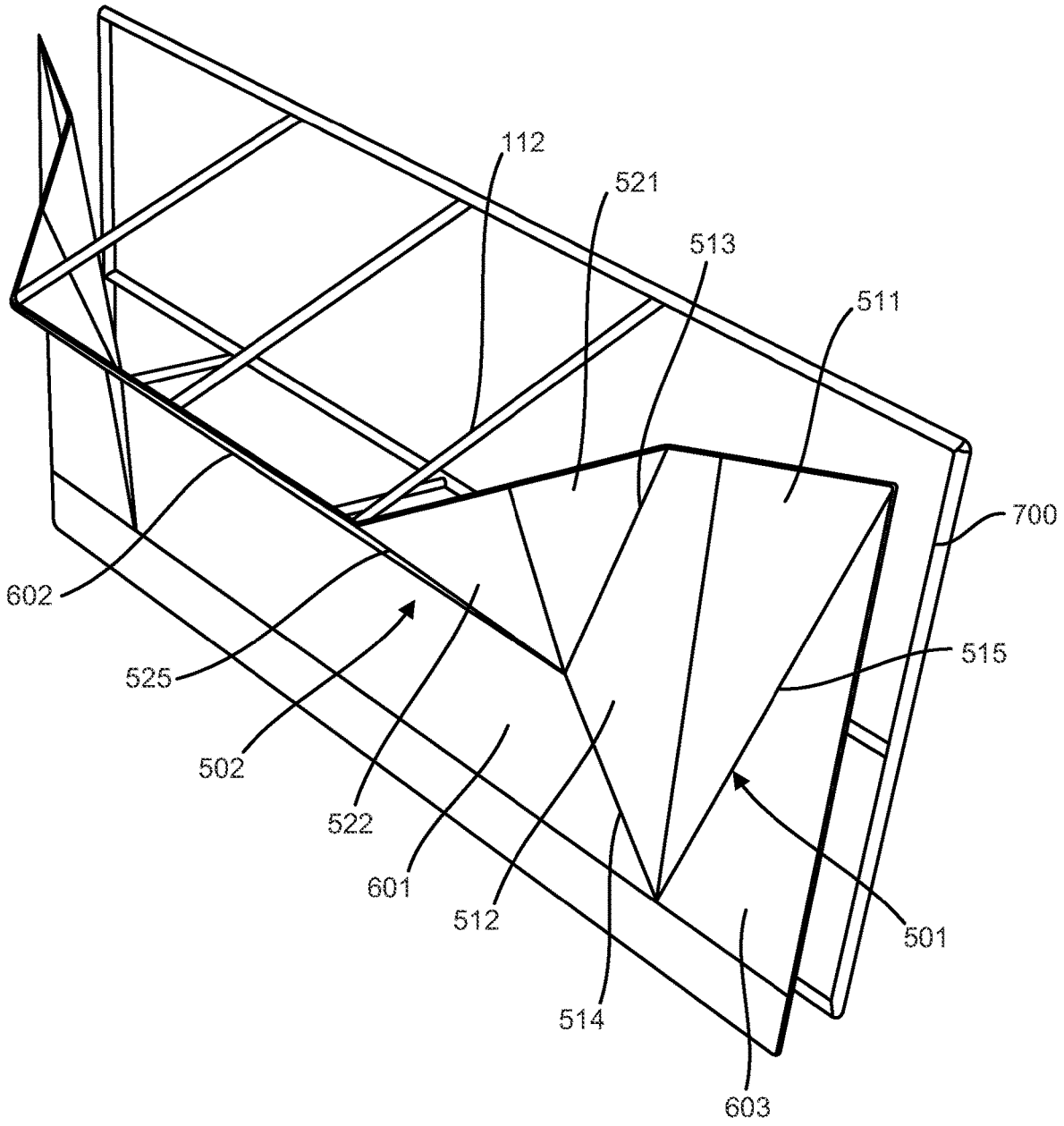
FIG. 14 is a front perspective view of a climbing wall having a compound expandable climbing panel in accordance with an embodiment of the present disclosure, showing the climbing wall in a first, convex orientation.
Figure 15:
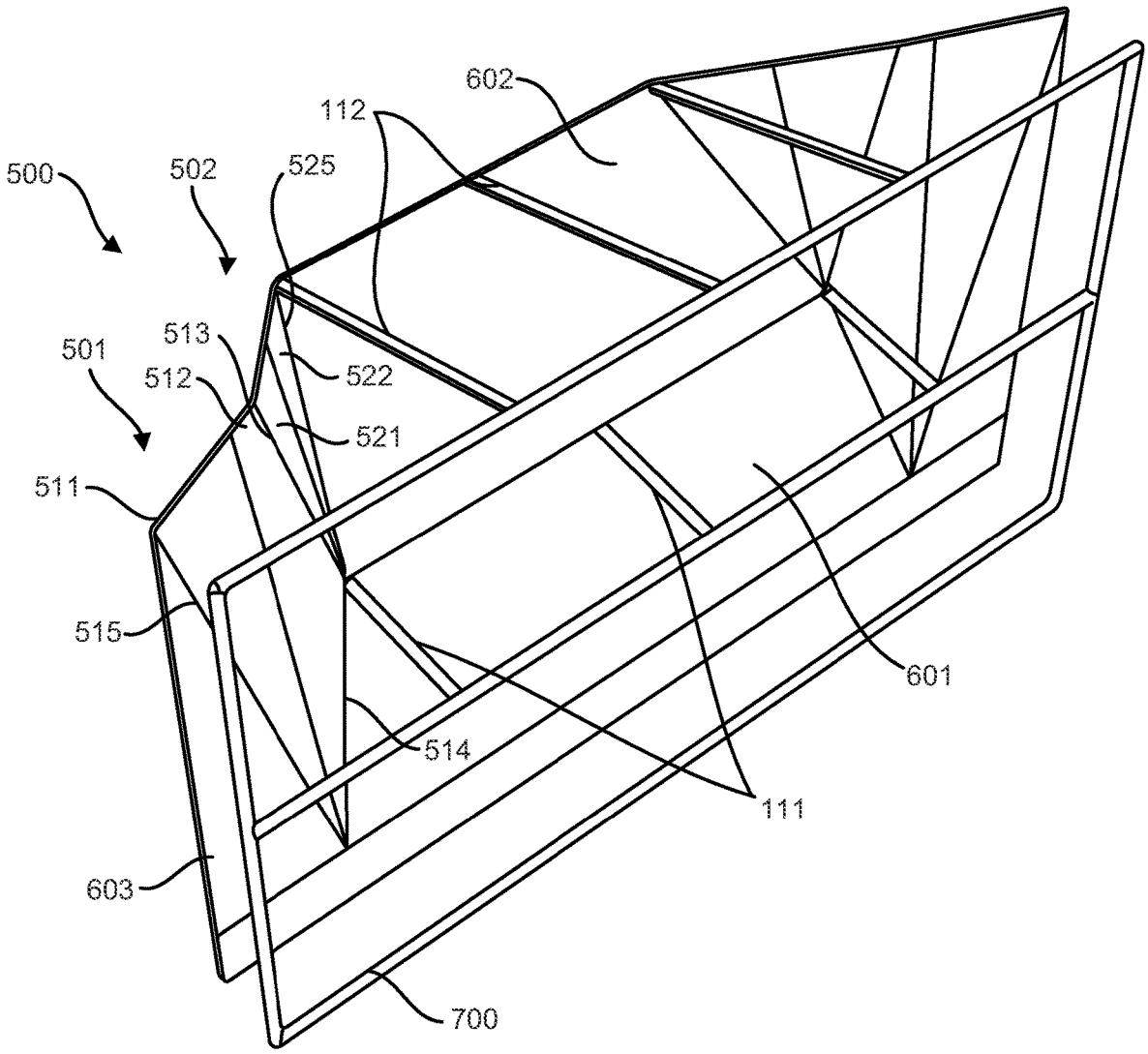
FIG. 15 is a rear perspective view of the climbing wall shown in FIG. 14.
Figure 16:
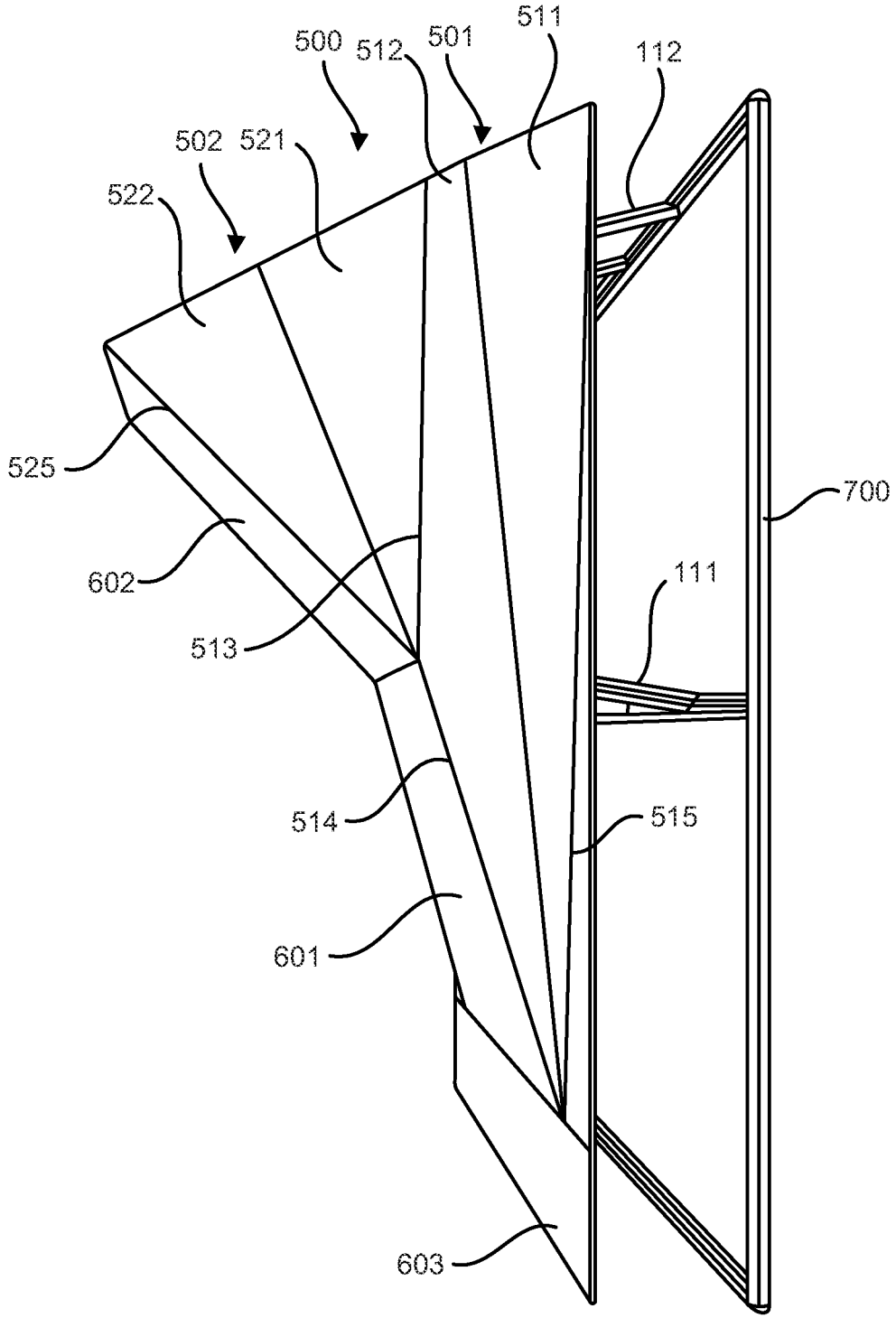
FIG. 16 is a side elevation view of the climbing wall shown in FIG. 14.
Figure 17:
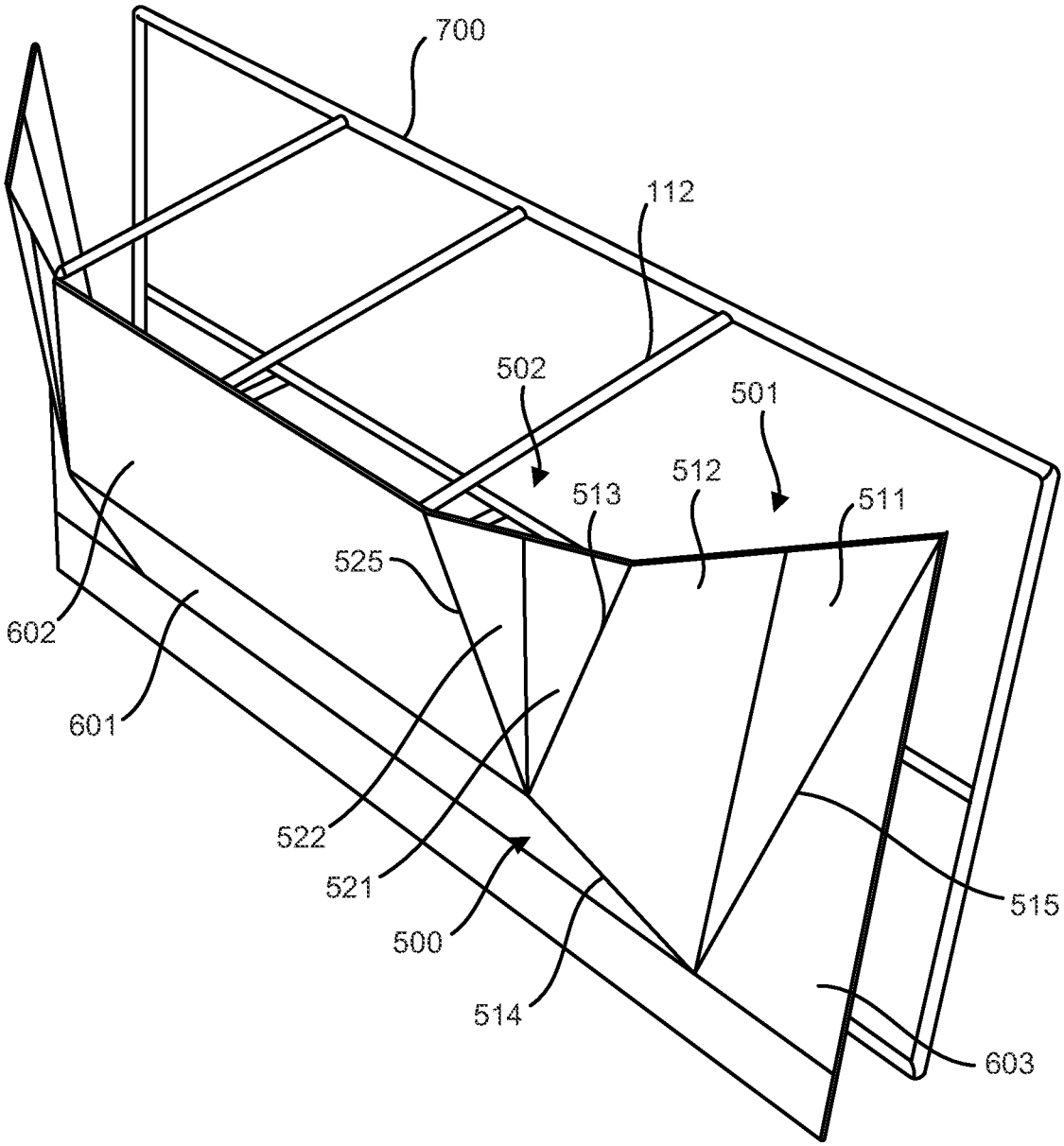
FIG. 17 is a front perspective view of the climbing wall shown in FIG. 14, showing the climbing wall in a second, concave orientation.
Figure 18:
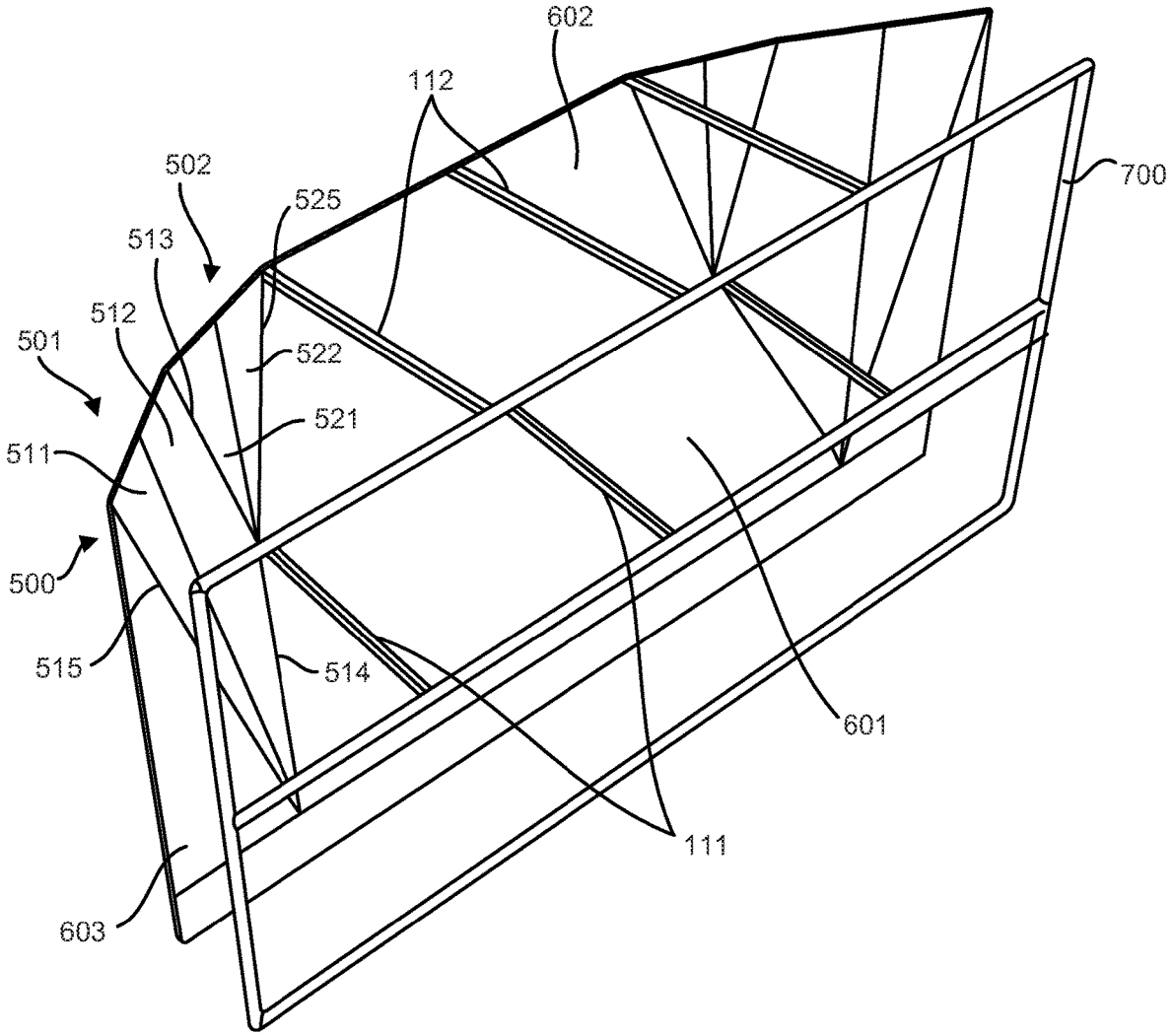
FIG. 18 is a rear perspective view of the climbing wall shown in FIG. 17.
Figure 19:
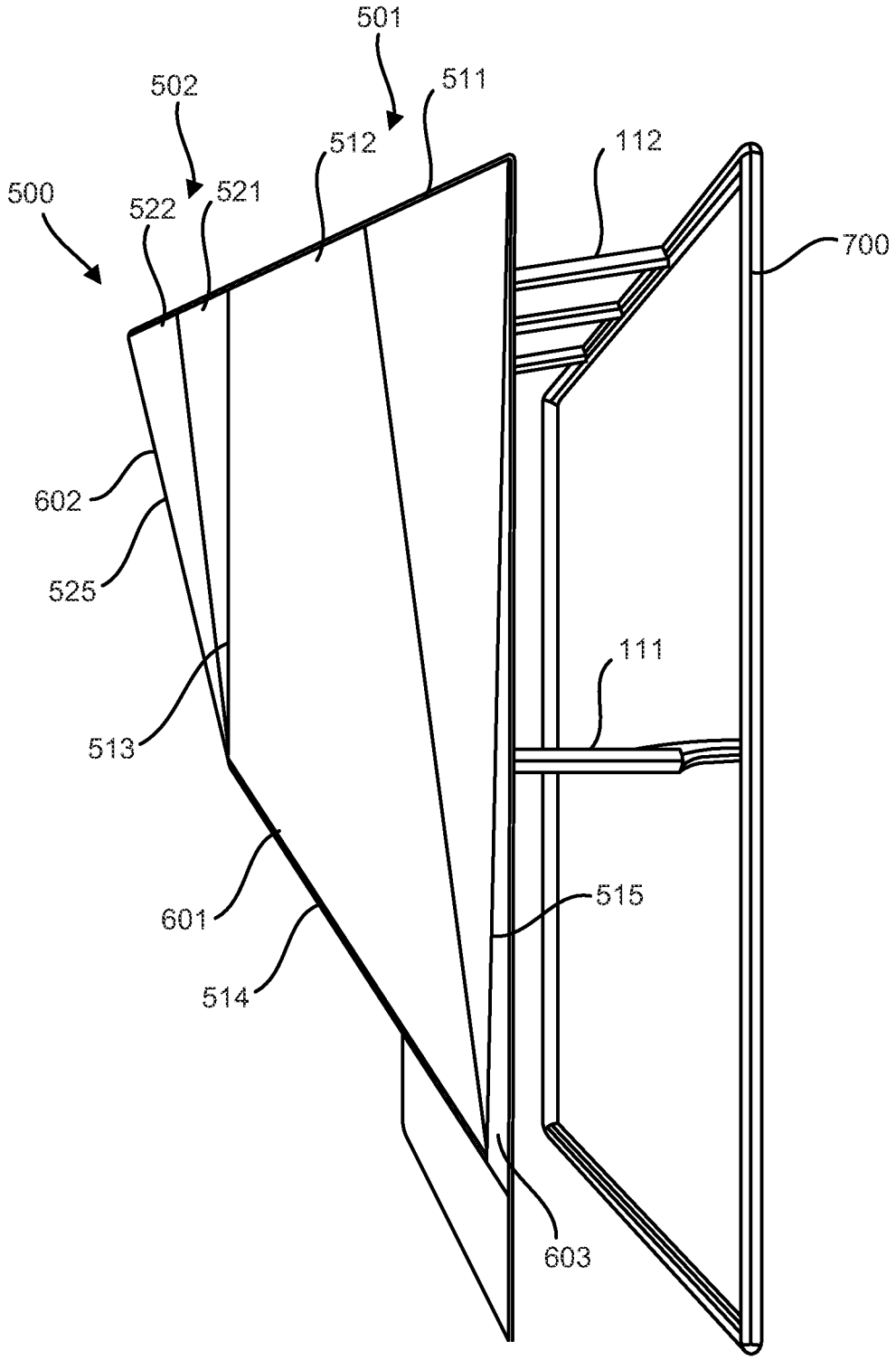
FIG. 19 is a side elevation view of the climbing wall shown in FIG. 17.

Using a compound expandable climbing panel 500 of the sort described herein, a climbing wall 100 may be moved between a variety of climbing configurations. Given the additional flexibility provided by a compound expandable climbing panel 500, an even greater array of climbing surfaces may be produced. A first example configuration is shown in FIGS. 14-16. And a second example configuration is shown in FIGS. 17-19.

In the first configuration (FIGS. 14-16), the first wall portion 601 has been brought to a lesser angle relative to vertical than the second wall portion 602 (which has thus been brought to a greater angle relative to vertical than the first wall portion). As best seen in FIG. 16, this produces a convex climbing surface between the first wall portion 601 and the second wall portion 602. In the second configuration (FIGS. 17-19), the first wall portion 601 has been brought to a greater angle relative to vertical than the second wall portion 602 (which has thus been brought to a lesser angle relative to vertical than the first wall portion). As best seen in FIG. 19, this produces a concave climbing surface between the first wall portion 601 and the second wall portion 602. In both configurations, the climbing surface provided by wall portions 601 and 602 remain continuous with the climbing surface provided by the compound expandable climbing panel 500 and with the climbing surface provided by wall portion 603. Of course, by placing each of wall portions 601 and 602 at different angles (to say nothing of moving wall portion 603), one may create any number of additional wall configurations, each of which provides a continuous climbing surface.

Figure 20:
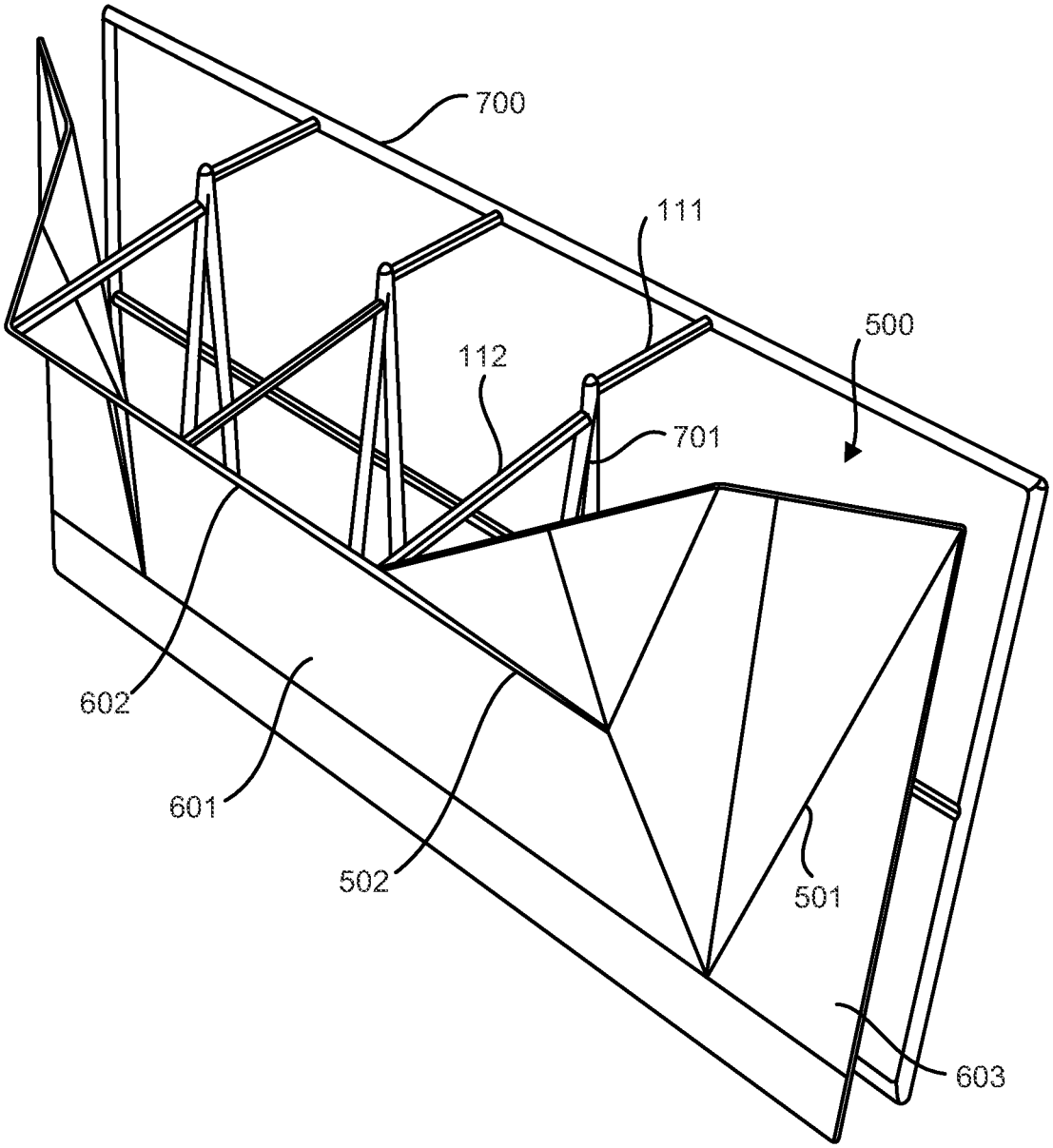
FIG. 20 is a front perspective view of a climbing wall having a compound expandable climbing panel in accordance with another embodiment of the present disclosure, showing the climbing wall in a first orientation.
Figure 21:
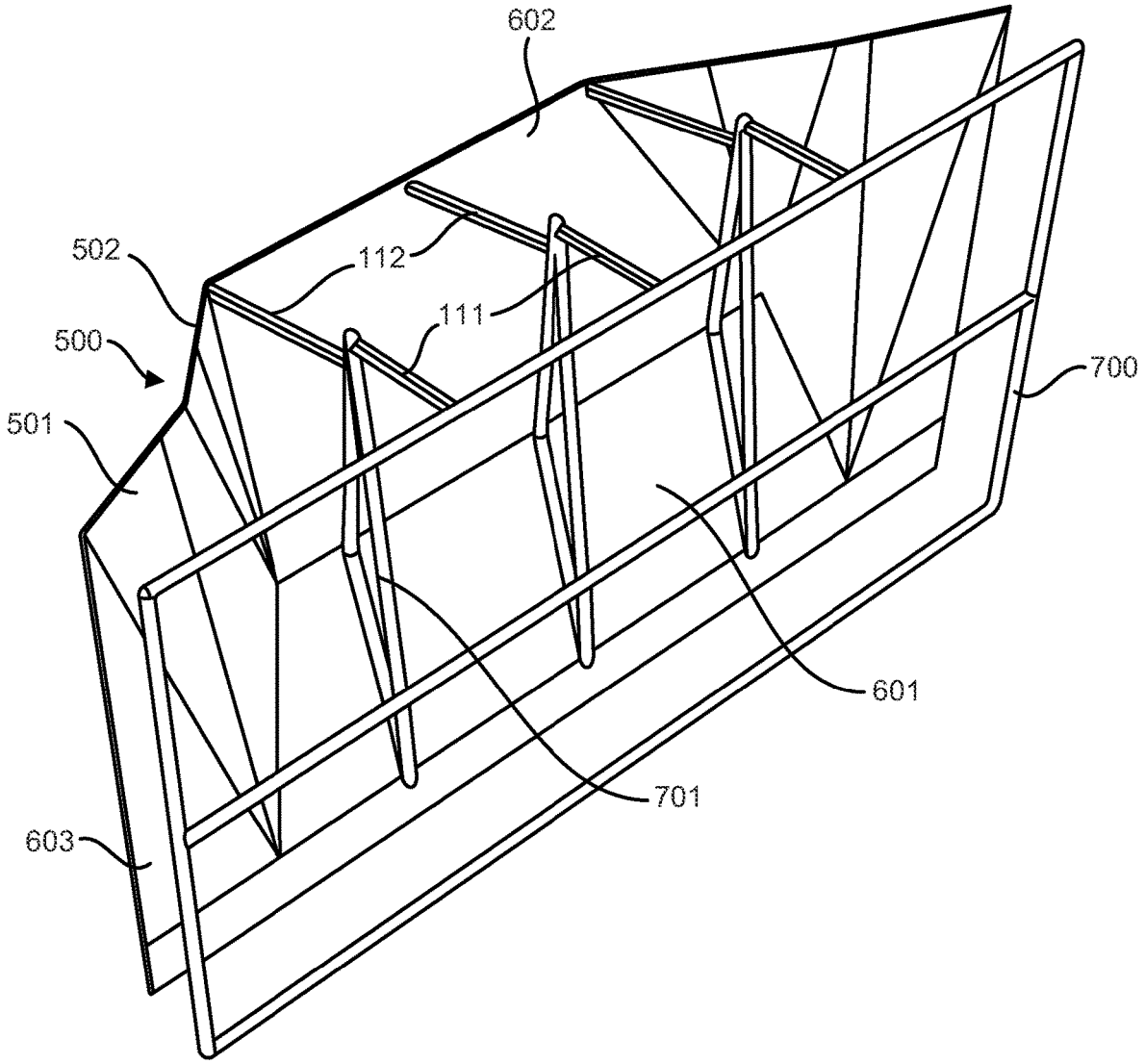
FIG. 21 is a rear perspective view of the climbing wall shown in FIG. 20.
Figure 22:
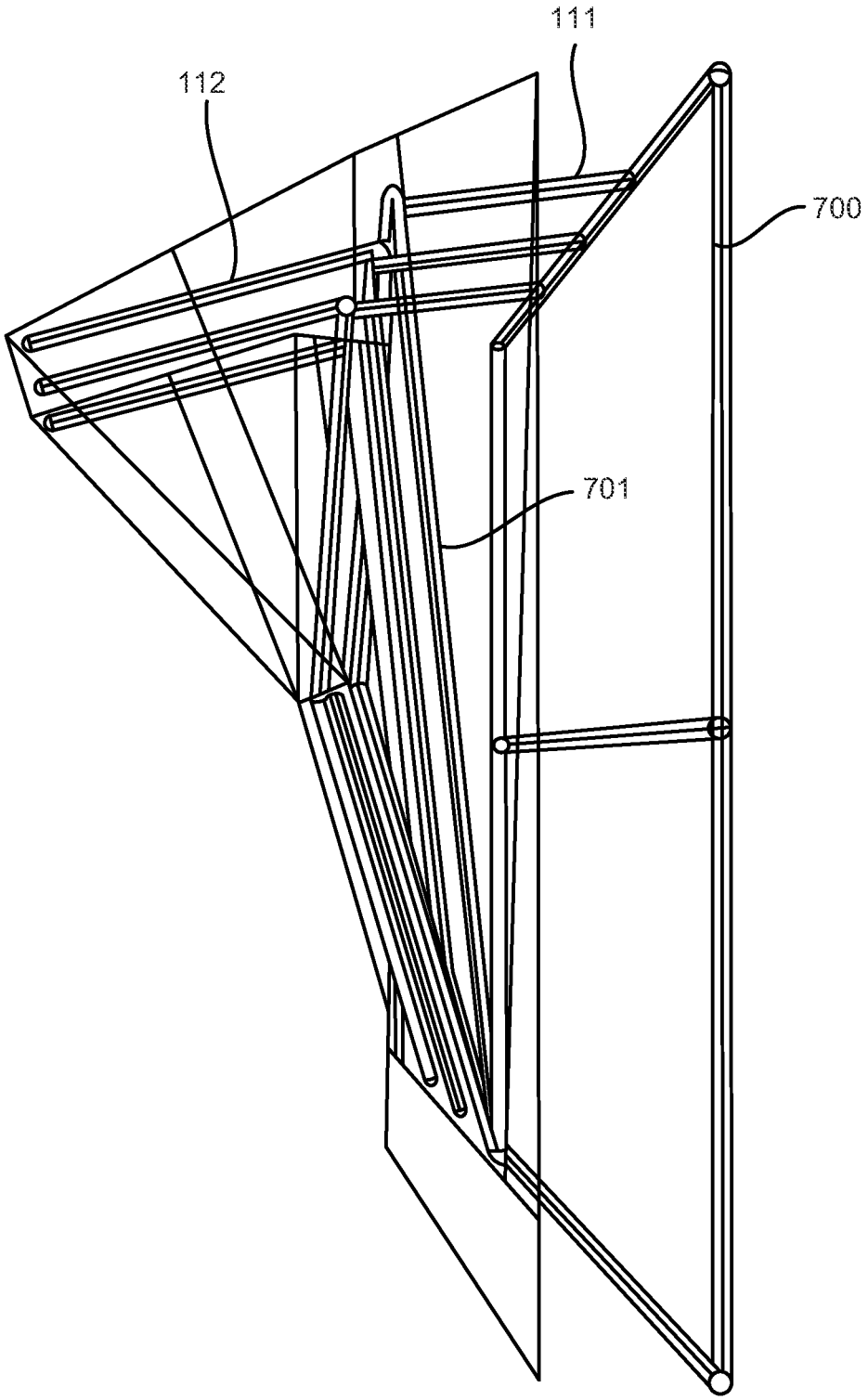
FIG. 22 is a side elevation view, partly in section, of the climbing wall shown in FIG. 20.

Another embodiment of a climbing wall 100 having a compound expandable climbing panel 500 is shown in FIGS. 20 through 22. This embodiment is similar to that shown in FIGS. 14-19, with the exception that this climbing wall 100 further comprises a truss 701 connected to the first wall portion 601 and hingedly attached to support structure 700. In addition to providing enhanced structural support to the wall 100, truss 701 provides an alternative manner to operate the first expandable climbing panel 501 and the second expandable climbing panel 502.

As illustrated, for instance, the actuator or set of actuators 111 may have a first end connected to the support frame 700 and a second end connected to the truss 701. The actuator or set of actuators 112 may have a first end connected to the truss 701 and a second end connected to the second wall portion 602 (more specifically to the framework of the second wall portion). Accordingly, by operating actuator 111, one may change the angle of the first wall portion 601 by angling the truss 701 about its hinged connection with support structure 700. This may cause only the first expandable climbing panel 501 of the compound panel 500 to expand or retract. By operating actuator 112, one may change the angle of the second wall portion 602 in much the same manner described and shown previously (though the actuator 112 may be of a shorter length, as it is attached to the closer truss 701 instead of the farther support structure 700). This may cause only the second expandable climbing panel 502 of the compound panel 500 to expand or retract.

In addition to the trusses 701 shown in this embodiment, other alternative connection mechanisms are also contemplated without departing from the scope of the presently disclosed invention.

In any of the above-identified embodiments, one or more of the actuators may also comprise a position sensor. The position sensor could be operatively connected to a processor, e.g. a computer or PLC. By inputting a particular set of wall portion positions, e.g. angles for each wall portion in a given climbing wall, the actuators could use position sensor data to bring each wall portion to the desired position. In this way, for instance, each of a plurality of climbing walls could be brought into identical configurations.

It can be seen that the described embodiments provide a unique and novel expandable climbing panel 10 and/or climbing wall 100 that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A climbing wall assembly comprising:

an adjustable-incline wall portion comprising a climbing surface configured to receive a plurality of climbing grips and a framework;

a fixed frame element that supports a lower edge of the adjustable-incline wall portion in a raised position relative to a ground surface, the lower edge of the adjustable-incline wall portion being hingedly connected to a top of the fixed frame element;

a support structure positioned behind the adjustable-incline wall portion; and a system for changing an incline of the adjustable-incline wall portion, the system comprising:

a truss attached to the support structure by a hinged connection, a first actuator having a first end connected to the support structure and a second end connected to the truss, the first actuator being configured to change an angle of the truss about the hinged connection between the truss and the support structure, wherein operation of the first actuator to change the angle of the truss about its hinged connection with the support structure serves to change the incline of the adjustable-incline wall portion about the hinged connection between the lower edge of the adjustable-incline wall portion and the top of the fixed frame element; and wherein the truss is connected to the adjustable-incline wall portion by a second actuator, the second actuator having a first end connected to the truss and a second end connected to the adjustable-incline wall portion.

2. The climbing wall assembly of claim 1, wherein the first actuator is selected from the group consisting of a pneumatic linear actuator, a hydraulic linear actuator, and an electric linear actuator.

3. The climbing wall assembly of claim 1, wherein the fixed frame element comprises a front surface which provides a lower, fixed climbing surface.

4. The climbing wall assembly of claim 1, wherein the top of the fixed frame element is at least twelve inches above the ground surface.

5. The climbing wall assembly of claim 1, wherein the adjustable-incline wall portion comprises an upper portion and a lower portion, the upper portion being hingedly connected to the lower portion; and wherein the second actuator is configured to change the angle of the upper portion about the hinged connection between the upper portion and the lower portion.

6. The climbing wall assembly of claim 5, wherein the second actuator is selected from the group consisting of a pneumatic linear actuator, a hydraulic linear actuator, and an electric linear actuator.

* * * * *